US007976011B2

(12) United States Patent
Shibuya

(10) Patent No.: US 7,976,011 B2
(45) Date of Patent: Jul. 12, 2011

(54) IMAGE-FORMING APPARATUS AND CONTROL METHOD THEREOF

(75) Inventor: Yuichiro Shibuya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 700 days.

(21) Appl. No.: 12/041,381

(22) Filed: Mar. 3, 2008

(65) Prior Publication Data

US 2008/0224378 A1 Sep. 18, 2008

(30) Foreign Application Priority Data

Mar. 14, 2007 (JP) ..... 2007-065778

(51) Int. Cl.
*B65H 3/44* (2006.01)

(52) U.S. Cl. ..... 271/9.02; 271/9.05

(58) Field of Classification Search ..... 271/9.02, 271/9.05

See application file for complete search history.

(56) References Cited

U.S. PATENT DOCUMENTS

| | | | | |
|---|---|---|---|---|
| 4,985,736 | A * | 1/1991 | Kawano et al. | 399/391 |
| 5,323,220 | A * | 6/1994 | Yasuda | 399/391 |
| 5,963,755 | A * | 10/1999 | Ueda et al. | 399/23 |
| 6,176,481 | B1 * | 1/2001 | Ohkoda | 271/9.05 |
| 7,140,605 | B2 * | 11/2006 | Suga et al. | 271/97 |
| 2002/0063881 | A1 | 5/2002 | Nakata et al. | |
| 2003/0042666 | A1 * | 3/2003 | Stevens | 271/9.02 |
| 2004/0041328 | A1 * | 3/2004 | DiNatale et al. | 271/97 |
| 2004/0186617 | A1 * | 9/2004 | Bantlin et al. | 700/229 |
| 2005/0056988 | A1 * | 3/2005 | Lee et al. | 271/9.05 |
| 2008/0258374 | A1 * | 10/2008 | Inoue | 271/9.03 |
| 2009/0160117 | A1 * | 6/2009 | Negishi | 271/3.14 |

FOREIGN PATENT DOCUMENTS

| | | | |
|---|---|---|---|
| EP | 0879779 | A | 11/1998 |
| JP | 05-147287 | A | 6/1993 |
| JP | 05-286590 | | 11/1993 |
| JP | 06-199437 | | 7/1994 |
| JP | 10-017168 | A | 1/1998 |
| JP | 2002-040881 | | 2/2002 |
| JP | 2002-229285 | A | 8/2002 |
| JP | 2005-298102 | A | 10/2005 |

OTHER PUBLICATIONS

Nov. 5, 2009 European Search Report of the counterpart European Patent Application No. 0815296.2.
U.S. Appl. No. 12/041,351, filed Mar. 3, 2008.

* cited by examiner

*Primary Examiner* — Stefanos Karmis
*Assistant Examiner* — Howard Sanders
(74) *Attorney, Agent, or Firm* — Cowan, Liebowitz & Latman, P.C.

(57) ABSTRACT

When a first feeding unit is not ready to perform air feeding at the beginning of a print job, roll feeding using a second feeding unit is performed; when it is determined that the first feeding unit is ready to preform air feeding, air feeding using the first feeding unit is preformed. Upon execution of a print job by roll feeding, a preparation is started to make the first feeding unit ready to air feeding. When the first feeding unit is ready to execute the print job by air feeding, the print job is executed by exchanging roll feeding to air feeding using the first feeding unit.

21 Claims, 14 Drawing Sheets

| EMBODIMENT | THIRD EMBODIMENT | FIFTH EMBODIMENT | SIXTH EMBODIMENT |
|---|---|---|---|
| CONDITION | TOTAL NUMBER OF PAGES | TOTAL NUMBER OF REMAINING PAGES | PRESENCE / ABSENCE OF JOB |
| EXAMPLE 1 | 130 | 90 | PRESENT |
| EXAMPLE 2 | 50 | 10 | ABSENT |

IMAGE-FORMING APPARATUS AND CONTROL METHOD THEREOF

BACKGROUND OF THE INVENTION

1. Field of the Invention

The present invention relates to an image-forming apparatus and control method thereof and, more particularly, to an image-forming apparatus which comprises a plurality of sheet-feed units and a control method thereof.

2. Description of the Related Art

An image-forming apparatus such as a copying machine, printer, facsimile apparatus, or the like has a sheet container (sheet-feeding tray) which stores sheets, and transfers a sheet from the sheet container to an image-forming unit using a sheet-supply unit. An image is formed on the sheet which is transferred in this way, and the sheet on which the image has been formed is discharged outside the apparatus. As the sheet-supply unit of such image-forming apparatus, a sheet-supply unit of roller type which transfers a sheet downstream by rotation of sheet-feed rollers is generally used. In this sheet-supply unit of roller type, the surface of each roller is made up of an elastic member such as rubber or the like, and its feeding performance largely depends on the friction coefficient of the roller surface. The feeding performance may decline due to a change in outer shape of each roller, aging of the material of each roller, and a change in friction coefficient of the roller surface due to attachment of paper powder and the like. The sheet-supply unit of this type cannot support high-speed feeding and various sheets with different surface conditions.

In order to solve these problems, Japanese Patent Laid-Open No. 6-199437 has proposed an air-feeding apparatus which adopts an air-separation system. This air-feeding apparatus comprises handling means for handling upper sheets by blowing air to the end portion of sheets stacked in a sheet-stack unit, and absorptive transfer means for absorbing and transferring an uppermost sheet onto a conveyor belt.

A conventional image-forming apparatus has a plurality of sheet containers so as to form images on various types of sheets, and can store sheets of various sizes for respective sheet containers. Also, by storing sheets of an identical size in the plurality of sheet-supply units, an image-forming apparatus which stores sheets in large quantities in itself and can form images in large quantities is currently popular.

When the image-forming apparatus having the plurality of sheet-feed units uses air-feeding apparatuses, the following problems are posed.

The air-feeding apparatus equipped in each sheet-feed unit has means for handling upper sheets by blowing air to the end portion of a bundle of sheets, and means for absorbing an uppermost sheet on a transfer belt, and these means use pneumatic pressure. Upon using the pneumatic pressure, a time delay is produced until the pneumatic pressure acts on sheets in each sheet-feed unit even by extracting/suctioning air so as to attain feeding. Causes of such delay include the duct length, the switching time of an on-off valve in the duct used to switch air for each sheet-feed unit, a delay of a handling time due to the weight of sheets, and the like. In this way, the air-feeding apparatus suffers a low throughput of jobs due to a time delay until the pneumatic pressure acts on sheets even upon starting the sheet feeding.

Japanese Patent Laid-Open No. 2002-40881 describes a technique that checks if sheet containers other than that which has caused an "out of paper" error store sheets with an identical size, and continues to feed sheets from the sheet container without stopping the feeding operation if such a sheet container is found. With this function, the operation stop time due to the "out of paper" error is shortened, and print job efficiency is enhanced.

Japanese Patent Laid-Open No. 5-286590 has proposed an air-feeding apparatus which eliminates exchange delay time of sheet-feed units by applying air to two feeding apparatuses all the time. In this Japanese Patent Laid-Open No. 5-286590, one air extraction device and air supply device distribute extracted air and supply air to a plurality of trays. By setting a pressure that allows feeding sheets upon opening on-off valves of two trays, on-off control means executes valve control to always open the two on-off valves. With this control, since the two on-off valves are always open, no or little pneumatic pressure variation occurs even when sheets are fed from both of the two trays. Thus, upon exchange of sheet-feed units, the pneumatic pressure on the tray side can be quickly changed to a value required for the operation. In this manner, an air-feeding apparatus which can prevent the throughput of print jobs from lowering by eliminating any exchange loss of sheet-feed units has been proposed.

As described above, air feeding can meet a higher-speed image-forming apparatus compared to roll feeding. However, since the air feeding requires much time until it becomes ready to feed, a time required until first printing (the first print output after the image-forming apparatus accepts a job execution instruction) is prolonged. On the other hand, roll feeding cannot support the highest print speed of a printer engine in case of continuous print and feeding.

SUMMARY OF THE INVENTION

It is an object of the present invention to eliminate the above-described problems of the conventional technology.

An advantage of the present invention is to execute a print job at high speed while shortening a time required from reception of a print job until execution of printing in an image-forming apparatus that allows both roll feeding and air feeding.

According to an aspect of the present invention, there is provided an image-forming apparatus comprising: a first feeding unit configured to perform sheet feeding from a source of sheets using air; a second feeding unit configured to perform sheet feeding from a source of sheets using a roller; a determination unit configured to determine a state of the first feeding unit; and a control unit configured to: in a case that the determination unit determines that the first feeding unit is not ready to feed sheets for a print job that allows feeding from one of the first feeding unit and the second feeding unit, cause feeding by the second feeding unit, and in a case that the determination unit determines that the first feeding unit is ready to feed sheets for a print job that allows feeding from one of the first feeding unit and the second feeding unit, cause feeding by the first feeding unit.

According to another aspect of the present invention, there is provided a control method of controlling an image-forming apparatus which comprises a first feeding unit for performing sheet feeding from a source of sheets using air, and a second feeding unit for performing sheet feeding from a source of sheets using a roller, comprising the steps of: determining a state of air feeding in the first feeding unit; and if it is determined that the first feeding unit is not ready to feed sheets for a print job that allows feeding from one of the first feeding unit and the second feeding unit, performing feeding using the second feeding unit; and if it is determined that the first feeding unit is ready to feed sheets for a print job that allows feeding from one of the first feeding unit and the second feeding unit, performing feeding using the first feeding unit.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Numerous embodiments of the present invention will now herein be described below in detail with reference to the accompanying drawings. The following embodiments are not intended to limit the claims of the present invention, and not all combinations of features described in the embodiments are essential to the present invention.

Figure 1:
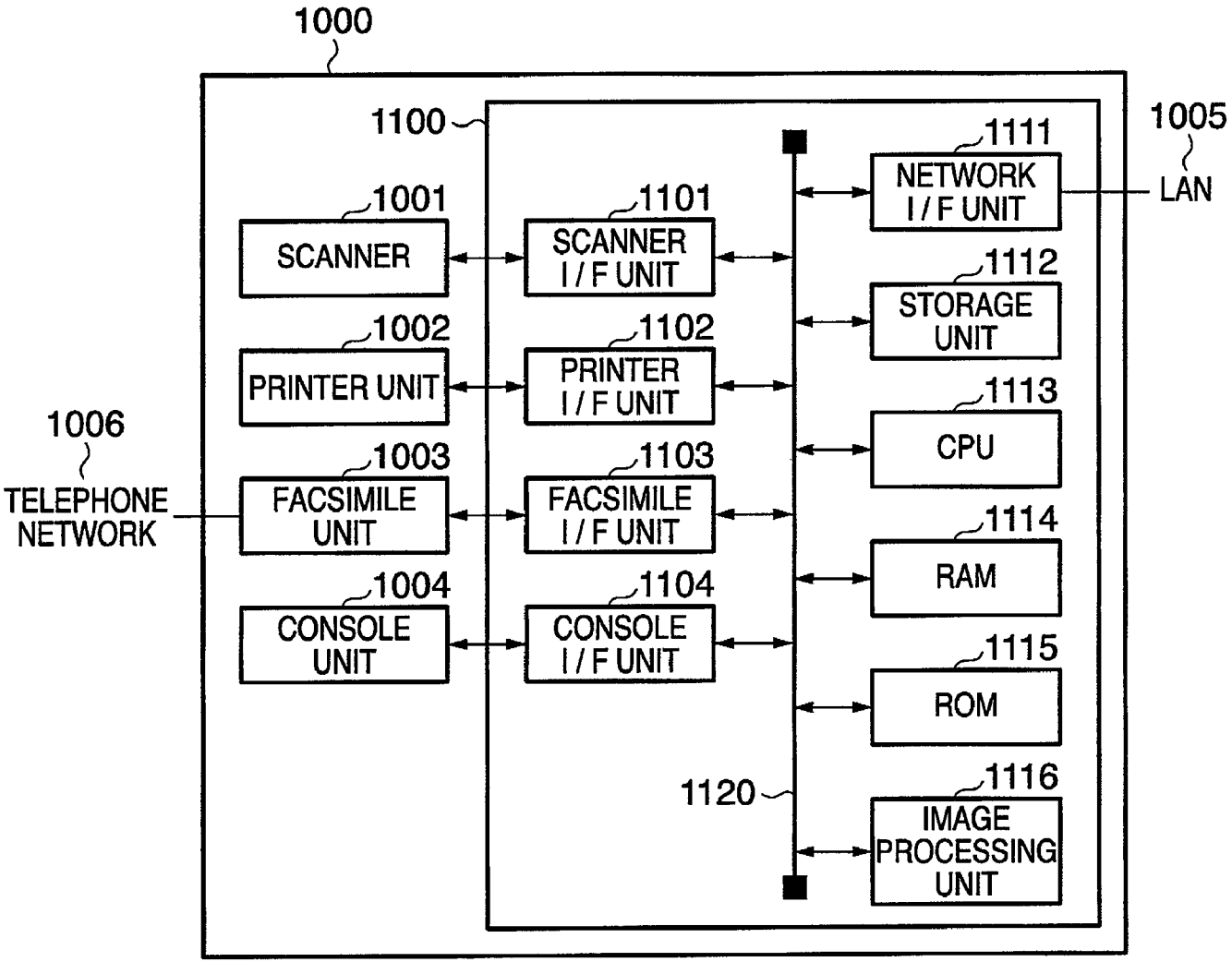
FIG. 1 is a block diagram showing the arrangement of a digital multi function peripheral (MFP) according to an exemplary embodiment of the present invention.

FIG. 1 is a block diagram showing the arrangement of a digital multi-function peripheral (MFP) 1000 as an example of an image-forming apparatus according to an exemplary embodiment of the present invention.

In this MFP 1000, a scanner 1001, printer unit 1002, facsimile unit 1003, and console unit 1004 are connected to a controller 1100. The console unit 1004 has a display unit used to display warnings and messages to the user, and various keys, switches, and the like to be operated by the user. The MFP 1000 is connected to a LAN 1005 via a network interface (I/F) unit 1111, and a telephone network 1006 is connected to the facsimile unit 1003.

The arrangement of the controller 1100 will be described below. A CPU 1113 is connected to a system bus 1120. The CPU 1113 is connected, via this bus 1120, to a scanner I/F unit 1101, a printer I/F unit 1102, a facsimile I/F unit 1103, a console I/F unit 1104, and the network I/F unit 1111. The CPU 1113 is also connected to a storage unit 1112, RAM 1114, ROM 1115, and image-processing unit 1116. The operations of the respective units will be described below based on the flows of signals among these units.

Image data supplied from the scanner 1001 undergoes image processing in the image-processing unit 1116 via the scanner I/F unit 1101, and is stored in the RAM 1114. A control command issued by the scanner 1001 is transferred to the CPU 1113. Print data received via the LAN 1005 is rasterized by the image-processing unit 1116 via the network I/F unit 1111, and is transferred to and stored in the RAM 1114. A control command received by the network I/F unit 1111 is transferred to the CPU 1113. Facsimile data received via the telephone network 1006 is transferred to the RAM 1114 via the facsimile unit 1003. A control command supplied from the facsimile unit 1003 is transferred to the CPU 1113.

These image data stored in the RAM 1114 undergo image processing such as rotation processing, zoom processing, and the like of images by the image-processing unit 1116 under the control of the CPU 1113. After that, the image data are sent to the printer unit 1002 via the printer I/F unit 1102 or are transmitted onto the telephone network 1006 via the facsimile unit 1003.

Upon reception of a display request onto the console unit 1004 from the scanner I/F unit 1101 or the facsimile unit 1003, the CPU 1113 displays the designated display contents on the display unit of the console unit 1004. Furthermore, when the user makes a key operation on the console unit 1004, the operation information is supplied to the CPU 1113 via the console I/F unit 1104. The CPU 1113 determines based on the contents of the key operation whether the operation information received from the console I/F unit 1104 is transferred to the scanner I/F unit 1101 or facsimile unit 1003. Also, the CPU 1113 executes input/output control of image data based on the operation information. The network I/F unit 1111 can transmit and receive data in accordance with communication protocols.

A control program of the CPU 1113 which executes such control is stored in the ROM 1115, and the CPU 1113 operates based on the control program stored in the ROM 1115. Note that the RAM 1114 is used as a work area when the CPU 1113 executes various kinds of control processing.

Figure 2:
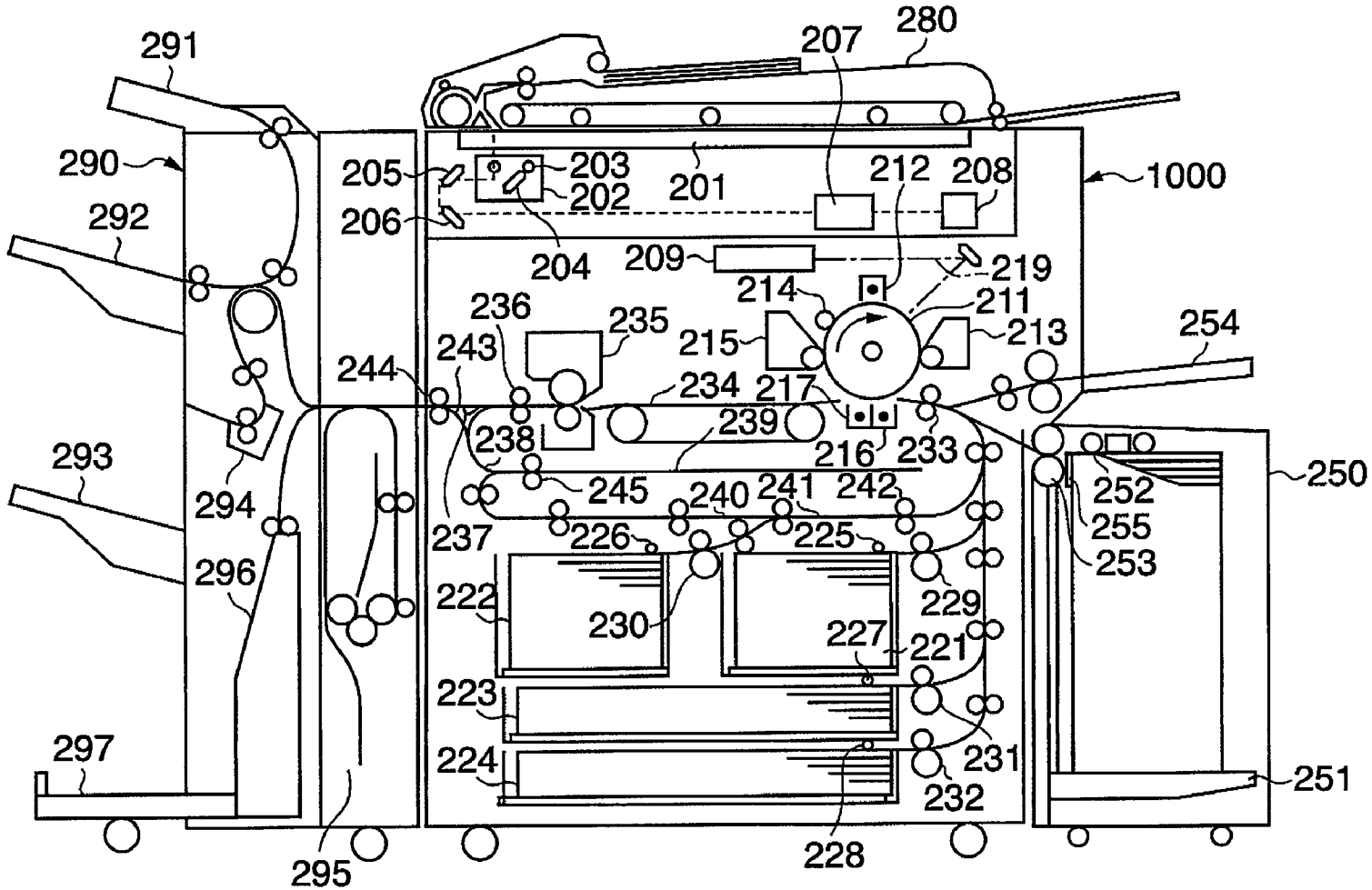
FIG. 2 depicts a schematic sectional view for explaining the structure of the digital MFP according to the embodiment of the present invention.

FIG. 2 depicts a schematic sectional view explaining the structure of the digital MFP 1000 according to this embodiment.

An auto document feeder (ADF) 280 is equipped on the upper portion of this digital MFP 1000. A platen glass 201 is used to place a document to be scanned. A scanner unit 202 has a lamp 203 for lighting, mirror 204, and the like, and is reciprocally scanned in predetermined directions by rotation of a motor (not shown). Light reflected from a document irradiated with light from this scanner unit 202 is transmitted through a lens 207 via mirrors 204 to 206 and forms an image on an image sensor 208 (CCD sensor).

An exposure controller 209 has a laser, polygonal scanner, and the like, and irradiates a photosensitive drum 211 with a laser beam 219, which is modulated based on an image signal obtained by applying the image processing to an electrical signal supplied from the image sensor 208 by the image-processing unit 1116. Around this photosensitive drum 211, a primary charger 212, developer 213, transfer charger 216, pre-exposure lamp 214, and cleaning unit 215 are equipped.

The photosensitive drum 211 rotates in the direction of an arrow shown in FIG. 2 upon rotation of a motor (not shown). After the surface of the photosensitive drum 211 is charged to a desired potential by the primary charger 212, it is irradiated with the laser beam 219 from the exposure controller 209 to form an electrostatic latent image. The electrostatic latent image formed on the photosensitive drum 211 is developed by the developer 213 to be visualized as a toner image.

On the other hand, transfer sheets (to be also referred to as print sheets or simply as sheets; including sheets of materials other than paper like OHP sheets) stored in a right cassette deck 221, left cassette deck 222, upper cassette 223, or lower cassette 224 are picked up upon rotation of a pickup roller 225, 226, 227, or 228. The picked-up sheet is transferred into the main body upon rotation of sheet-feed rollers 229, 230, 231, or 232. The sheet transferred into the main body is fed onto a transfer belt 234 by registration rollers 233. After that, the toner image visualized on the photosensitive drum 211 is transferred onto the sheet by the transfer charger 216. The surface of the photosensitive drum 211 after the toner image is transferred is cleaned by the cleaning unit 215, and the residual charge is cleared by the pre-exposure lamp 214.

The sheet on which the toner image is transferred is separated from the photosensitive drum 211 by a separation charger 217, and is fed to a fixing unit 235 by the transfer belt 234. The fixing unit 235 fixes the toner image on the sheet by applying a pressure and heat. The sheet on which the toner image is fixed is discharged outside the main body upon rotation of discharge rollers 236.

This MFP 1000 equips a deck 250 that can store, e.g., 4000 sheets. This deck 250 adopts a so-called air-separation system, and is of a type that separates and feeds in turn from an uppermost sheet. A lifter 251 of the deck 250 moves upward according to the amount of sheets. The sheets are handled one by one by air blowing out from a blow-out duct 255. Then, an upper sheet is absorbed by an absorbing duct 252, and is fed into the main body upon rotation of sheet-feed rollers 252. Also, a manual feed tray 254 which can store 100 sheets is equipped.

Furthermore, a discharge flapper 237 switches the route to the side of a transfer path 238 or to that of a discharge path 243. A down transfer path 240 reverses the sheet fed from the discharge rollers 236 via a reverse path 239, and guides the sheet to a re-feed path 241. A sheet fed from the left cassette deck 222 by the sheet-feed rollers 230 is also guided to the re-feed path 241. Re-feed rollers 242 re-feed the sheet to the transfer unit having the aforementioned transfer charger 216 and the like.

Discharge rollers 244 are allocated near the discharge flapper 237, and discharge, outside the apparatus, the sheet whose path is exchanged to the side of the discharge path 243 by the discharge flapper 237.

In case of double-sided printing (double-sided copying), the discharge flapper 237 is flipped upward to guide the image-formed sheet to the re-feed path 241 via the transfer path 238, reverse path 239, and down transfer path 240. At this time, the reverse rollers 245 pull the sheet onto the reverse path 239 until the trailing end of the sheet fully leaves the transfer path 238 and the reverse rollers 245 nip the sheet. Then, by reversing the reverse rollers 245, the sheet is fed onto the transfer path 240. When the sheet is reversed and is discharged from the main body, the discharge flapper 237 is flipped upward, and the reverse rollers 245 pull the sheet onto the reverse path 239 to a position where the trailing end of the sheet is still on the transfer path 238. After that, by reversing the reverse rollers 245, the sheet is reversed, and is fed toward the discharge rollers 244.

A discharge processing unit 290 stacks and aligns, on a processing tray 294, sheets discharged one by one from the digital MFP 1000. Upon completion of discharge of some image-formed sheets, a transferred (image-formed) sheet bundle is stapled and is discharged onto a discharge tray 292 or 293. The discharge tray 293 is controlled to move upward or downward by a motor (not shown), and moves to the position of the processing tray before the beginning of an image forming operation. On a sheet tray 291, partition sheets to be inserted between discharged transferred sheets are stacked. A Z-folding device 295 Z-folds transferred sheets. A bookbinding device 296 center-folds and staples some discharged transferred sheets to bind them. The bound sheet bundle is discharged onto a discharge tray 297.

Figure 3:
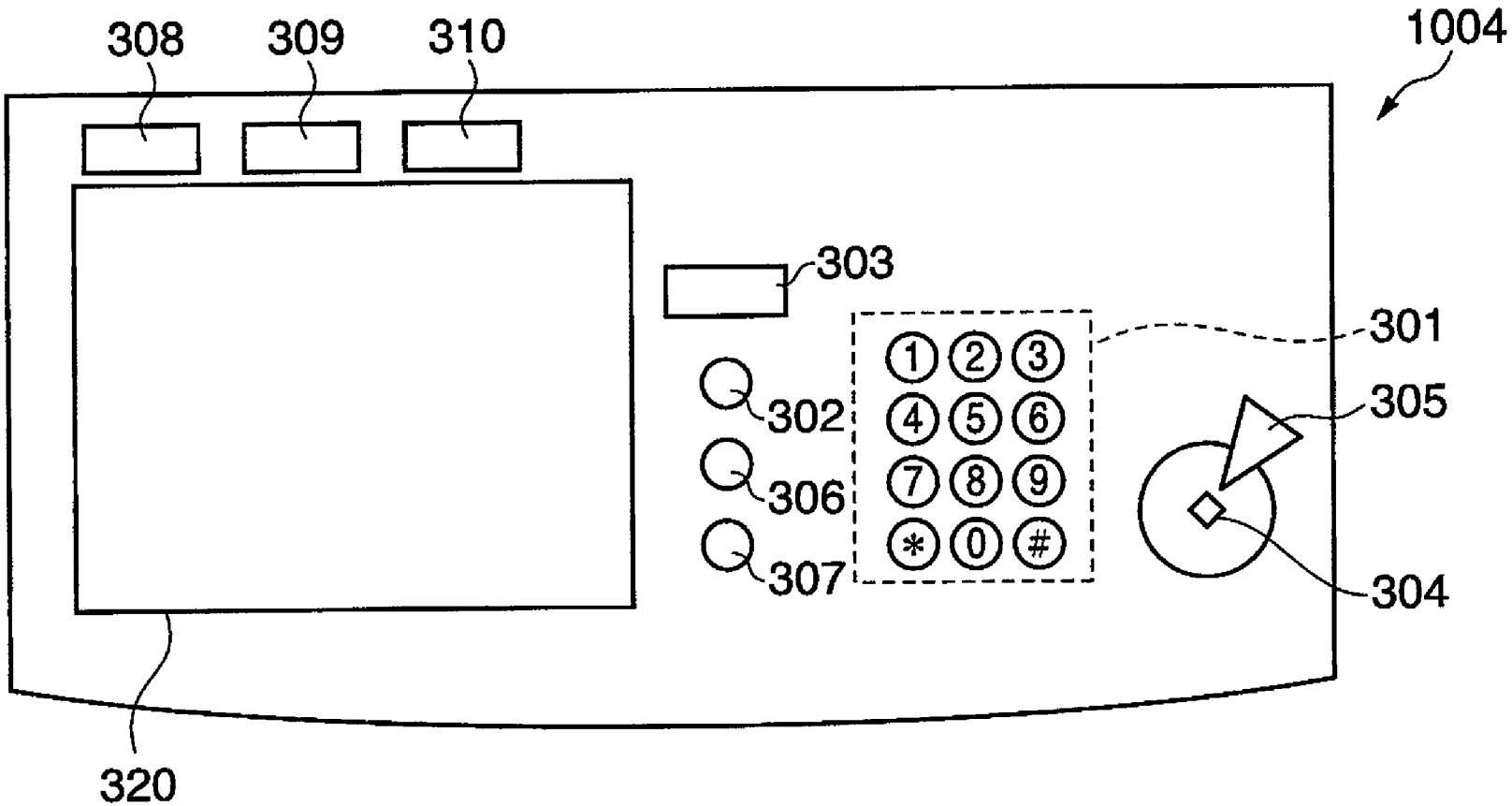
FIG. 3 depicts a perspective view showing the outer appearance of a console unit of the digital MFP according to the embodiment of the present invention.

FIG. 3 depicts a perspective view showing the outer appearance of the console unit 1004 of the digital MFP according to this embodiment.

A numeric keypad 301 is used to input a numeric value upon setting of the number of sheets which are to undergo image formation, and upon setting of a mode. On a facsimile setting window, the numeric keypad 301 is used to input, e.g., a telephone number. A clear key 302 is used to clear settings input using the numeric keypad 301. A reset key 303 is used to reset the set number of sheets which are to undergo image formation, operation mode, selection of sheet-feed units, and the like to prescribed values. A start key 304 is pressed when the user wants to start an image-forming operation. Red and green LEDs (not shown) are arranged at the center of this start key 304 so as to indicate if image formation is ready to start. If image formation is not ready to start, the red LED is turned on; if image formation is ready to start, the green LED is turned on. When the user wants to stop a copying operation, he or she uses a stop key 305. A guide key 306 is pressed when the user wants to know a given key function. Upon pressing the guide key 306, an explanation of a function of which the user wants to know is displayed on a display unit 320. An interrupt key 307 is pressed when the user wants to do another work during the image-forming operation.

The display unit 320 comprises a liquid crystal display or the like, and the display contents change according to a mode to be set so as to facilitate detailed mode settings. A touch sensor is provided to the surface of this display unit 320. When the user touches a part within the frame of a given function displayed on the display screen, that function is executed. A proof print function key as that used to execute proof printing is included in those displayed on the display screen. A copy function key 308, facsimile function key 309, and box function key 310 are respectively used to designate copy, facsimile, and box functions. Upon pressing of one of these keys, the display contents on the display unit 320 of the console unit 1004 are exchanged. Upon pressing of the copy function key 308, the user can make various settings associated with the copy function on a window (not shown). Upon pressing of the facsimile function key 309, the user can make various settings associated with the facsimile function on a window (not shown). The box function key 310 is pressed upon storing image data in the storage unit 1112 or upon printing out the stored image data.

Figure 4:
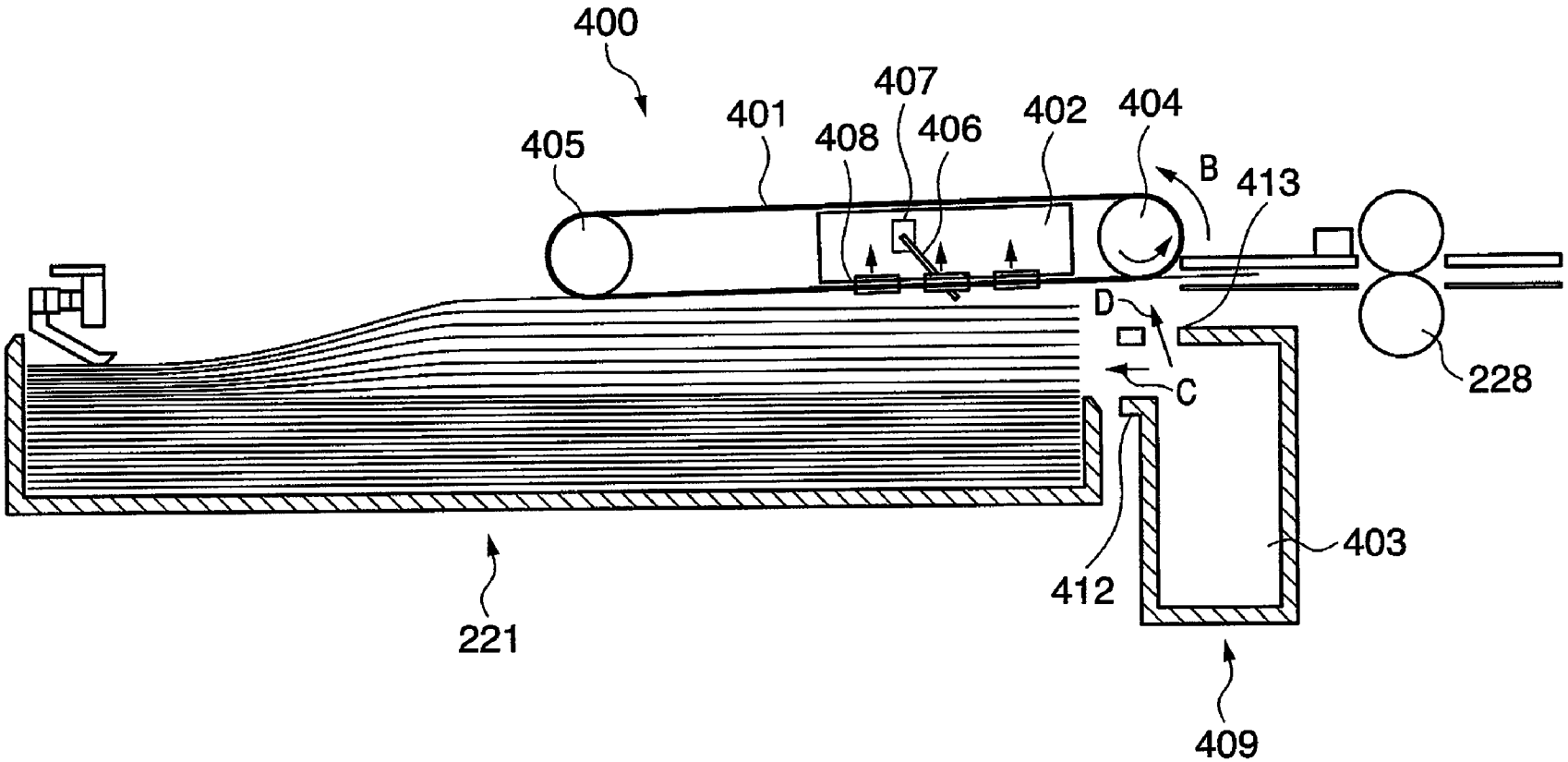
FIG. 4 depicts a sectional view explaining a sheet absorptive transfer unit provided to a right cassette deck according to the embodiment of the present invention.

FIG. 4 depicts a sectional view explaining a sheet absorptive transfer unit 400 provided to the right cassette deck 221 according to this embodiment. Note that this sheet absorptive transfer unit 400 may be provided to the left cassette deck 222, upper cassette 223, lower cassette 224, and deck 250 shown in FIG. 1. The digital MFP 1000 shown in FIG. 2 is an example in which a sheet absorptive transfer unit shown in FIG. 4 is equipped on the deck 250.

Figure 5:
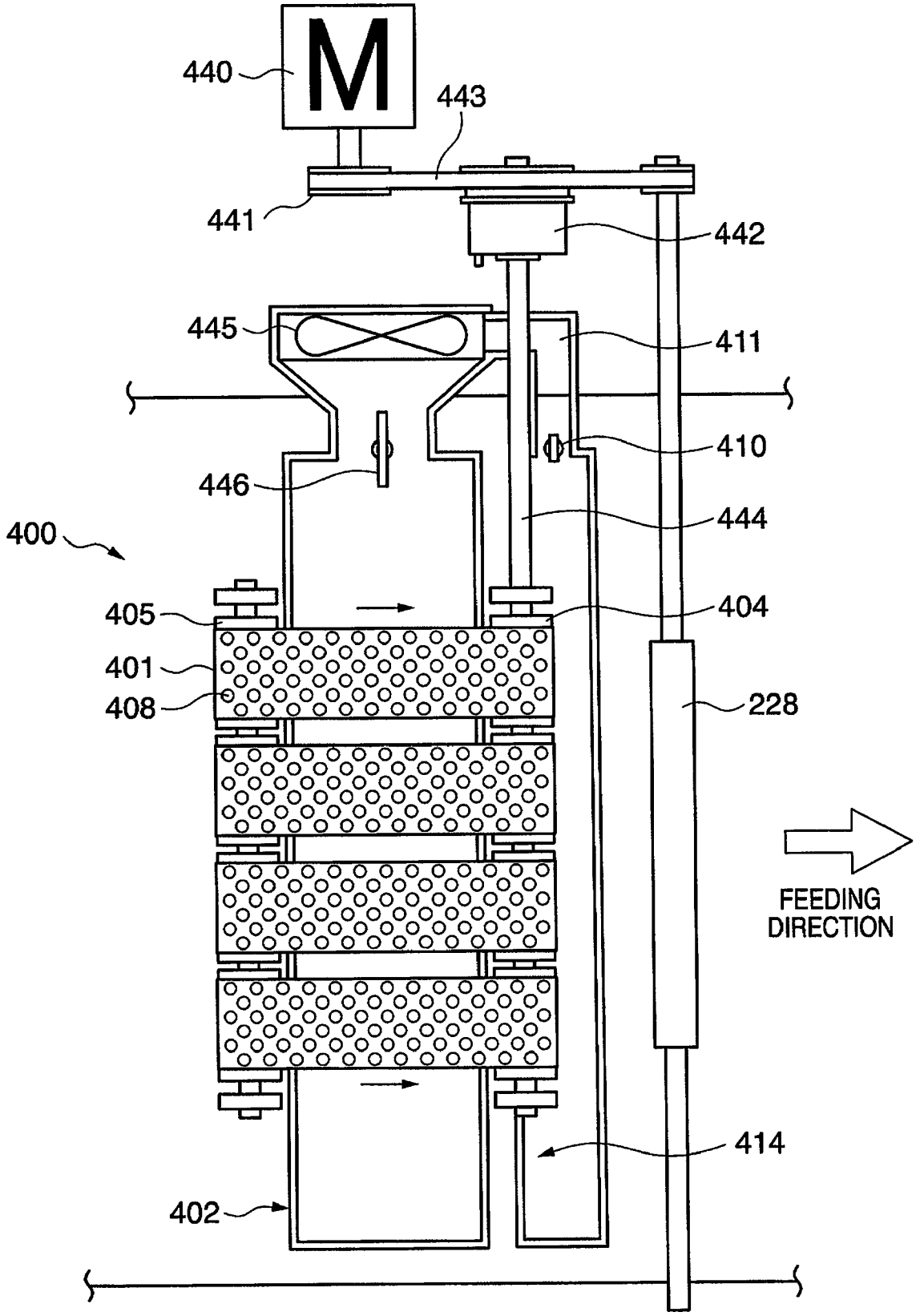
FIG. 5 depicts a bottom view explaining a driving unit of the sheet absorptive transfer unit according to the embodiment of the present invention when viewed from the sheet side.

This sheet absorptive transfer unit 400 includes a transfer belt 401, a driving unit shown in FIG. 5, absorbing duct 402, and a blow-out duct 403. The transfer belt 401 is allocated on the cassette deck 221 with its feeding direction side slanted slightly upward. This transfer belt 401 is wound around a driving roller 404 and a driven roller 405, and is rotated in the direction of an arrow B upon rotation of the driving roller 404. On the surface of the transfer belt 401, absorbing holes 408 used to absorb a sheet are formed. The absorbing duct 402 includes an absorptive sensor lever 406 which pivots upward when it is pressed by a sheet absorbed by the transfer belt 401. The absorbing duct 402 also includes an absorptive sensor 407 which outputs an absorption signal by detecting absorption of a sheet by the transfer belt 401 based on the upward pivotal motion of this absorptive sensor lever 406. Note that the mounting position of the sheet absorptive transfer unit 400 varies depending on the cassette deck 221 or 222, cassette 223 or 224, and deck 250. For example, the absorbing duct 252 equipped on the deck 250 shown in FIG. 2 corresponds to the absorbing duct 402 shown in FIG. 4, and the blow-out duct 255 corresponds to the blow-out duct 403 shown in FIG. 4.

FIG. 5 depicts a bottom view explaining the driving unit of the sheet absorptive transfer unit according to this embodiment when viewed from the sheet side.

This driving unit moves the transfer belt 401 in the direction of an arrow in FIG. 5 by rotating the driving roller 404. This driving unit comprises a motor 440, gear pulley 441, clutch 442, and the like, as shown in FIG. 5. The driving force of the motor 440 is transmitted to the input shaft of the clutch 442 via the gear pulley 441 and a belt 443. The clutch 442 is connected to a driving shaft 444 of the driving roller 404. Therefore, when the CPU 1113 connects the driving shaft 444 of the driving roller 404 to the clutch 442, the driving force of the motor 440 is transmitted to the driving roller 404 via the driving shaft 444, thus moving the transfer belt 401.

The absorbing duct 402 absorbs air via the absorbing holes 408 of the transfer belt 401, and is allocated within the path of the transfer belt 401. By activating a fan 445 (FIG. 5) and absorbing air via the absorbing duct 402, a negative pressure is produced near the absorbing holes 408. Inside the absorbing duct 402, an absorbing valve 446 used to adjust the absorbing amount of air is arranged (FIG. 5). Note that the air absorbed upon operation of the fan 445 is supplied to a separation unit 409 (FIG. 4), and is blown out.

The separation unit 409 helps absorptive transfer of a sheet by blowing air to the end portion of sheets to float and separate a sheet. This separation unit 409 comprises the blow-out duct 403, a valve 410, a junction duct 411, the fan 445, and the like.

The blow-out duct 403 is allocated downstream in the feeding direction of the cassette deck 221 and below the driving roller 404, as shown in FIG. 4. The blow-out duct 403 is formed with a handling nozzle 412 that blows out air in the direction of an arrow C (horizontal direction) in FIG. 4, and a separation nozzle 413 that blows out air in the direction of an arrow D. The air to be blown out from these handling nozzle 412 and separation nozzle 413 is supplied from the fan 445 via the junction duct 411. At the connecting portion between a blow-out duct 414 and the junction duct 411, a valve 410 used to adjust the air blow-out amount is allocated (FIG. 5). The degree of opening of the valve 410 is adjustable according to an instruction from the CPU 1113.

Figure 6:
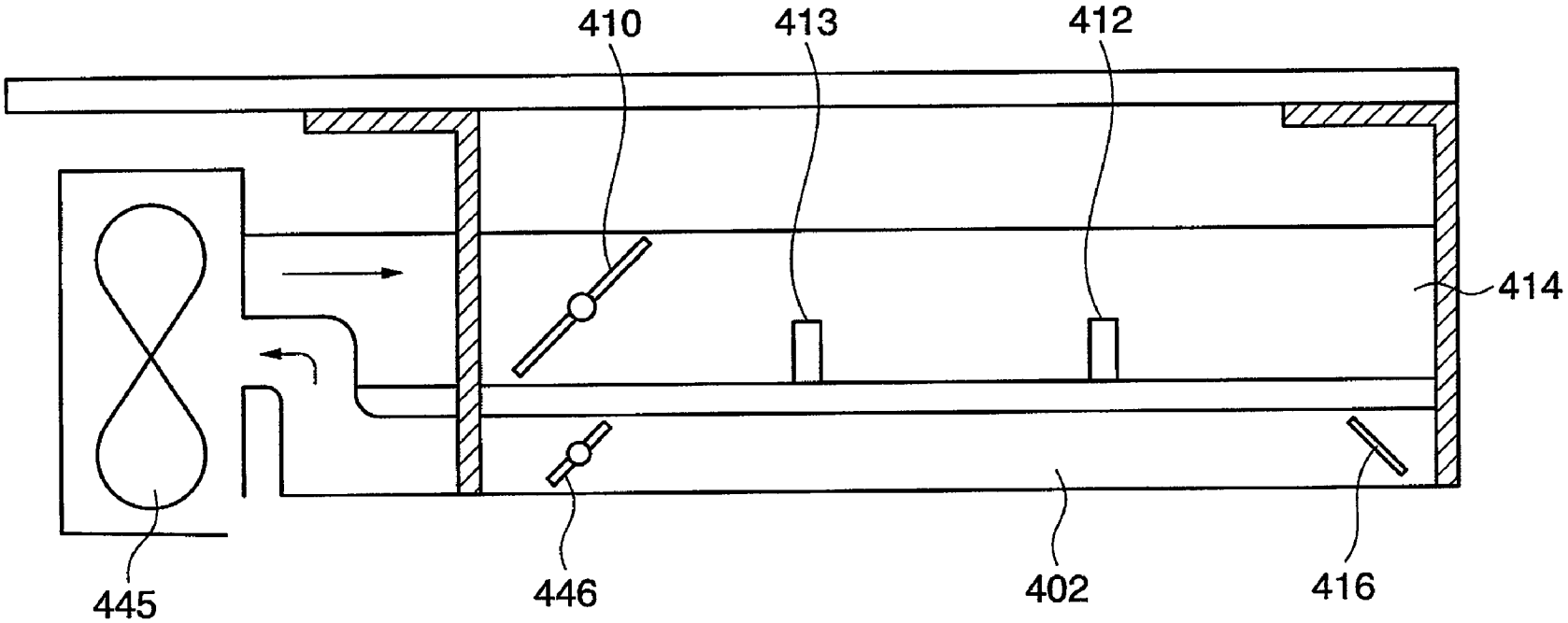
FIG. 6 depicts a side view of the sheet absorptive transfer unit according to the embodiment of the present invention when viewed from the left side of FIG. 5.

FIG. 6 depicts a side view of the sheet absorptive transfer unit according to this embodiment when viewed from the left side of FIG. 5.

The fan 445 is driven by a motor (not shown) which rotates according to an instruction from the CPU 1113. The fan 445 is also used to absorb air from the aforementioned absorbing duct 402, as shown in FIG. 5. That is, the fan 445 serves for both absorption in the sheet absorptive transfer unit 400 and air blasting in the separation unit 409. FIG. 6 shows the flows of air between the absorbing duct 402 and blow-out duct 414.

When such arrangement is adopted, the amount of air to be blown out from the blow-out duct 414 may become short by only performing absorption suited to absorb a sheet in some cases. Also, air may be blown out to the blow-out duct 414 without any absorption in the absorbing duct 402 in some cases. For these purposes, a portion of the absorbing duct 402 on the upstream side of an opening is open to the air. A relief valve 416 is arranged on the downstream side from this opening. This relief valve 416 closes the opening of the absorbing duct 402 by its self weight. However, when the negative pressure in the absorbing duct 402 becomes equal to or higher than a predetermined value, the relief valve 416 opens since it is pressed by the atmosphere pressure, so as to introduce air into the absorbing duct 402. That is, the relief valve 416 serves as a constant pressure valve. The sheet-feed rollers 229 transfer a sheet transferred by the sheet absorptive transfer unit 400 to the transfer unit, and are arranged downstream in the feeding direction of the sheet absorptive transfer unit 400.

The air feeding operation by the deck 250 which comprises the sheet absorptive transfer unit 400 shown in FIGS. 4, 5, and 6 will be described below.

The fan 445 and motor 440 are enabled to open the valve 410 and to supply air to the blow-out duct 403. As a result, the handling nozzle 412 and separation nozzle 413 blow out air in predetermined directions, thus starting handling processing. At this time, the air blown out from the handling nozzle 412 enters between sheets, thus making several upper sheets of the sheet bundle float while being handled. Note that this handling processing is executed for a predetermined period of time within which the floating several upper sheets of the sheet bundle would become stable.

After executing the aforementioned handling processing for the predetermined period of time, the absorbing valve 446 is opened. Then, a negative pressure is produced inside the absorbing duct 402, and an uppermost sheet S of those which float by the air from the handling nozzle 412 is absorbed on the surface of the transfer belt 401. At this time, the air blown out from the separation nozzle 413 separates the uppermost sheet from other sheets. In this manner, a sheet other than the uppermost sheet is never absorbed together.

When the absorptive sensor 407 provided in side the absorbing duct 402 detects absorption of a sheet on the surface of the transfer belt 401, the clutch 442 is connected to rotate the transfer belt 401. As a result, the sheet absorbed by the transfer belt 401 is transferred in the feeding direction. In this way, sheets loaded in the deck 250 are fed one by one.

The aforementioned handling processing is one of preparation processes required to attain air feeding from the cassette or deck (they will be generally referred to as an air-feeding unit hereinafter) which make air feeding. Upon completion of such preparation processes, the air-feeding unit can transit to a ready-to-feed state, thus starting feeding from the air-feeding unit.

First Embodiment

The exchange control processing between roll feeding and air feeding of the digital MFP according to the first embodiment of the present invention will be described below.

Figure 7:
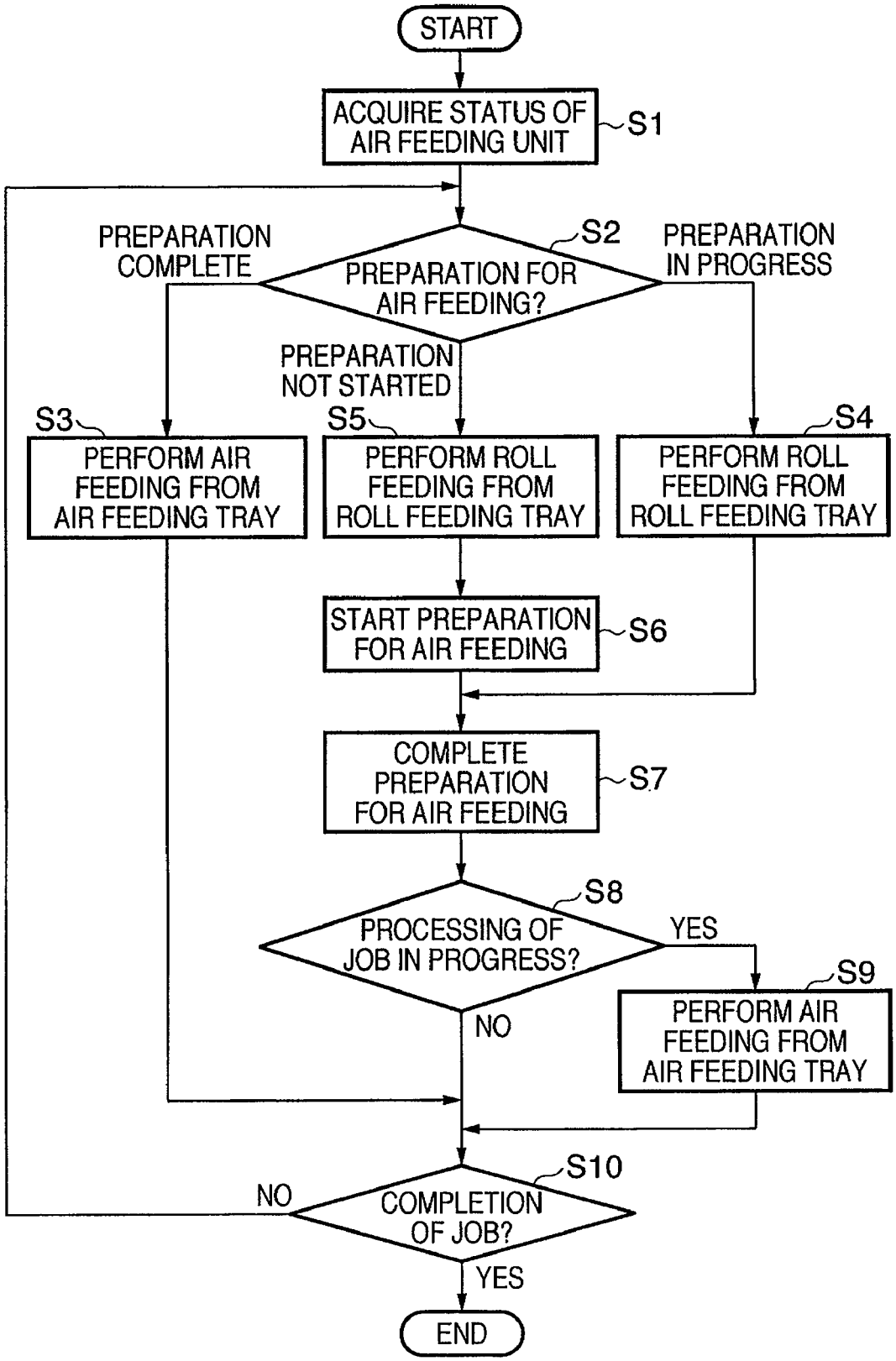
FIG. 7 is a flowchart explaining the processing for exchanging between roll feeding and air feeding of the digital MFP according to the first embodiment.

FIG. 7 is a flowchart explaining the processing for exchanging between roll feeding and air feeding of the digital MFP according to the first embodiment. Note that a program that implements this processing is stored in the ROM 115, and is executed under the control of the CPU 1113.

This processing starts when this digital MFP 1000 receives a print job. Assume that sheets which can be used in this print job are set in both the deck or cassette using roll feeding and that using air feeding in this digital MFP 1000. Also, assume that this print job is designated with print data of a plurality of pages or outputs of a plurality of copies. The digital MFP 1000 executes the print job to print on a plurality of sheets. In step S1, the CPU 1113 acquires the status of the air-feeding unit to discriminate the state of the air-feeding unit after reception of the print job. The CPU 1113 determines in step S2 whether or not a preparation to transfer sheets from the air-feeding unit is complete. In this embodiment, in order to determine whether or not the preparation to transfer sheets from the air-feeding unit is complete, the CPU 1113 determines whether or not the aforementioned handling processing is complete. More specifically, if a predetermined period of time has elapsed after the beginning of blowing out of air from the handling nozzle 412 and separation nozzle 413, the CPU 1113 determines that the handling processing is complete. Note that the process in step S2 may be implemented by other determination methods as long as it is determined whether or not the preparation to transfer sheets from the air-feeding unit is complete. If the CPU 1113 determines that the preparation to transfer sheets from the air-feeding unit is complete, the process advances to step S3 to execute the received print job by feeding sheets from the deck or cassette that stores corresponding sheets by air feeding. Then, the process advances to step S10.

On the other hand, if the CPU 1113 determines in step S2 that the preparation for the air-feeding unit is not complete because, e.g., the handling processing is underway but it is not complete yet (preparation for air feeding underway), the process advances to step S4. In step S4, the CPU 1113 executes the received print job by feeding sheets from the deck or cassette that allows roll feeding. The process then advances to step S7, and the CPU 1113 waits for completion of the preparation of air feeding.

If the handling processing is not started in step S2 (preparation for air feeding is not started), the process advances to step S5 to execute the received print job by feeding sheets from the deck or cassette that allows roll feeding. In step S6, the CPU 1113 starts the handling processing to start a preparation for air feeding. If a predetermined period of time has elapsed after the beginning of the handling processing, the deck or cassette that allows air feeding is ready to feed sheets in step S7. The process then advances to step S8, and the CPU 1113 determines whether a print job which requires to feed sheets from the deck 250 or another cassette and to print images on the fed sheets is in execution or not. If the print job is in execution, the process advances to step S9, and the CPU 1113 changes the source of the sheets to the deck or cassette that allows air feeding to continue execution of the print job. The process then advances to step S10. The process also advances to step S10 when no print job is in execution. In step S10, the CPU 1113 determines whether or not the print job is complete. If the print job is complete, the processing ends; otherwise, the process returns to step S2.

As described above, the first embodiment can meet high-speed image formation by printing while exchanging between air feeding and roll feeding. Also, the first embodiment can combat the shortcomings of air feeding, i.e., a long time required until the air-feeding unit is ready to operate, and can shorten a time required from when a print job is received until printing on the first sheet is complete.

Second Embodiment

In the first embodiment, if air feeding is ready, roll feeding is unconditionally exchanged to air feeding in step S9. By contrast, in the second embodiment, the number of pages of a print job is added as the exchange condition from roll feeding to air feeding in addition to the condition of the first embodiment described above.

Figure 8:
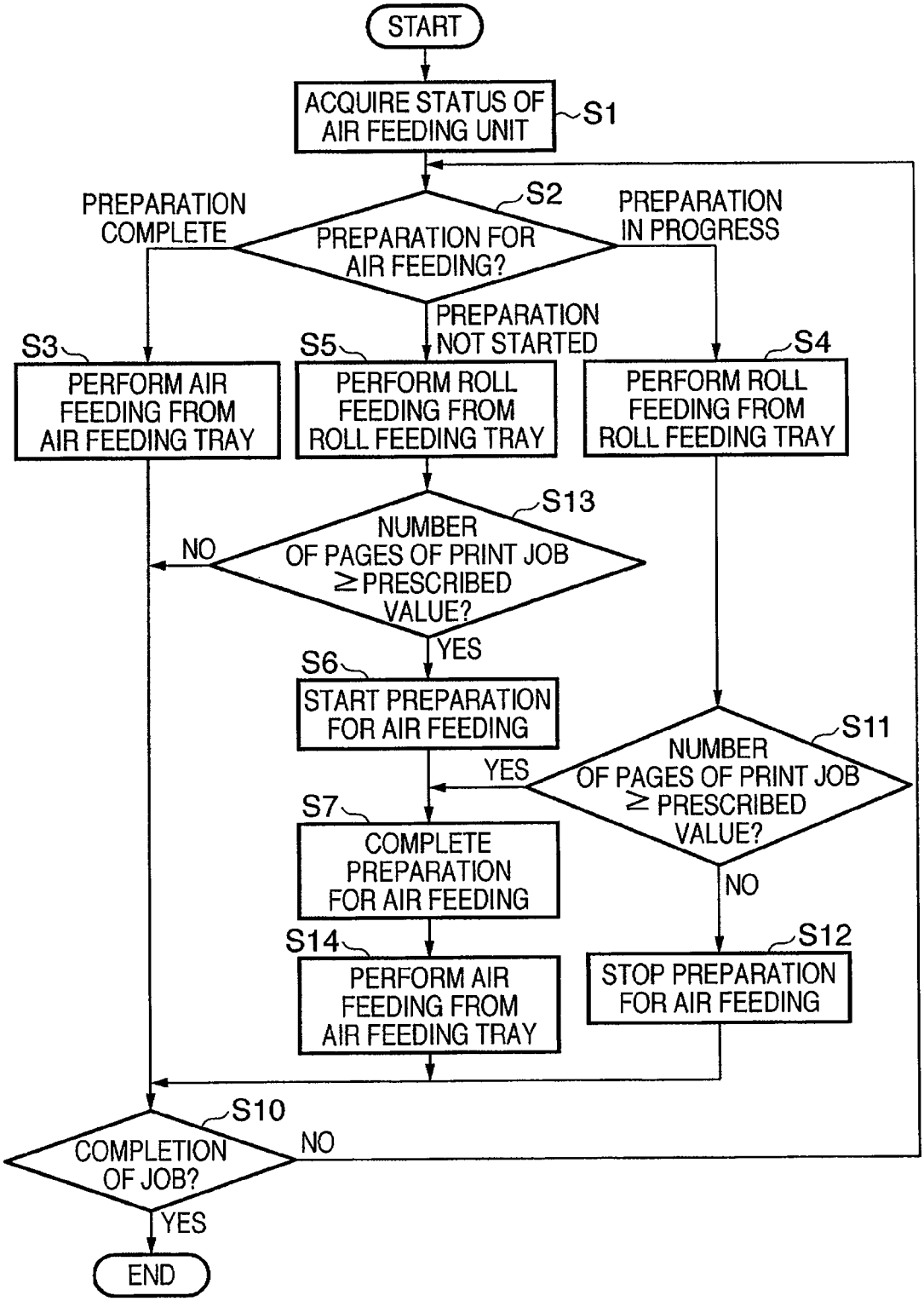
FIG. 8 is a flowchart explaining the processing for exchanging between roll feeding and air feeding of the digital MFP according to the second embodiment.

FIG. 8 is a flowchart explaining the processing for exchanging between roll feeding and air feeding in the digital MFP according to the second embodiment. Note that a program that implements this processing is stored in the ROM 115, and is executed under the control of the CPU 1113. Since the hardware arrangement of the digital MFP according to the second embodiment is the same as that in the first embodiment described above, a description thereof will be omitted. In FIG. 8, the same step numbers denote the steps (S1 to S7 and S10) that execute the same processes as those in FIG. 7.

This processing starts when this digital MFP 1000 receives a print job. Assume that sheets which can be used in this print job are set in both the deck or cassette using roll feeding and that using air feeding in this digital MFP 1000. Also, assume that this print job is designated with print data of a plurality of pages or outputs of a plurality of copies. The digital MFP 1000 executes this print job to print on a plurality of sheets. In step S1, the CPU 1113 acquires the status of the air-feeding unit to discriminate the state of the air-feeding unit after reception of the print job. The CPU 1113 determines in step S2 whether or not a preparation to transfer sheets from the air-feeding unit is complete. If the CPU 1113 determines that the preparation to transfer sheets from the air-feeding unit is complete, the process advances to step S3 to execute the received print job by feeding sheets from the deck or cassette that stores corresponding sheets by air feeding. Then, the process advances to step S10.

On the other hand, if the CPU 1113 determines in step S2 that the preparation for air feeding (handling processing, etc.) has started but it is not complete yet (preparation for air feeding underway), the process advances to step S4. In step S4, the CPU 1113 executes the received print job by feeding sheets from the deck or cassette that allows roll feeding. The process then advances to step S11 to determines whether or not the number of pages of the print job is equal to or larger than a prescribed value. If it is determined in step S11 that the number of pages of the print job is less than the prescribed value, the process advances to step S12 to stop the handling processing and to end the preparation processing of air feeding. The process then advances to step S10. This is because the CPU 1113 determines that the preparation processing for air feeding is not required, since it decides that the print job by means of roll feeding is completed before air feeding is ready when the number of pages to be printed in the print job is smaller than the prescribed value.

If the preparation for air feeding (handling processing) is not started in step S2, the process advances to step S5 to execute the received print job by feeding sheets from the deck or cassette that allows roll feeding. The process advances to step S13 to determine, as in step S11, whether or not the number of pages of the print job is equal to or larger than the prescribed value. If it is determined in step S13 that the number of pages of the print job is less than the prescribed value, the CPU 1113 continues roll feeding, and the process advances to step S10 without starting the preparation processing for air feeding.

On the other hand, if it is determined in step S13 that the number of pages of the print job is equal to or larger than the prescribed value, the process advances to step S6 to start the handling processing (to start the preparation for air feeding). If a predetermined period of time has elapsed after the beginning of the handling processing and the air feeding operation is ready in step S7, the process advances to step S14. In step S14, the CPU 1113 changes the source of the sheets from the cassette or deck that performs roll feeding to the deck 250 or cassette that allows air feeding. The process then advances to step S10. The CPU 1113 determines in step S10 whether or not the print job is complete. If the print job is complete, the processing ends; otherwise, the process returns to step S2.

Note that "the number of pages of the print job" may be replaced by the number of pages of a document to be printed. Alternatively, the total number of sheets to be fed by the MFP 1000 for the print job, which is determined by the number of pages of a document to be printed and the print settings for that print job, may be used. The print settings for the print job may include the number of copies to be printed, double/single-sided settings, imposition settings (N-up or the like), and so forth.

In step S12, the preparation processing for air feeding may be continued without being stopped. However, in such case, even when the preparation processing for air feeding is complete, the print job is executed using sheets fed from the roll feeding tray without changing the source from the roll feeding tray to the air-feeding unit.

As described above, according to the second embodiment, a decision as to whether or not the number of pages of the print job is equal to or larger than the prescribed value is added as the exchange condition from roll feeding to air feeding. As a result, if the number of pages of the print job is small (less than the prescribed value), the print job is continued without exchange from roll feeding to air feeding. Thus, any loss time due to needless exchange of feeding can be prevented from being produced. Also, by omitting the preparation for unnecessary exchange of feeding, the consumption power of the apparatus can be reduced.

Third Embodiment

In the second embodiment, if air feeding is ready, roll feeding is exchanged to air feeding depending on the number of pages of the print job as the condition. By contrast, in the third embodiment, the total number of pages of all print jobs, which can be attained by either air feeding or roll feeding and are scheduled to be continuously executed, is used as the exchange condition from roll feeding to air feeding.

Figure 9A:
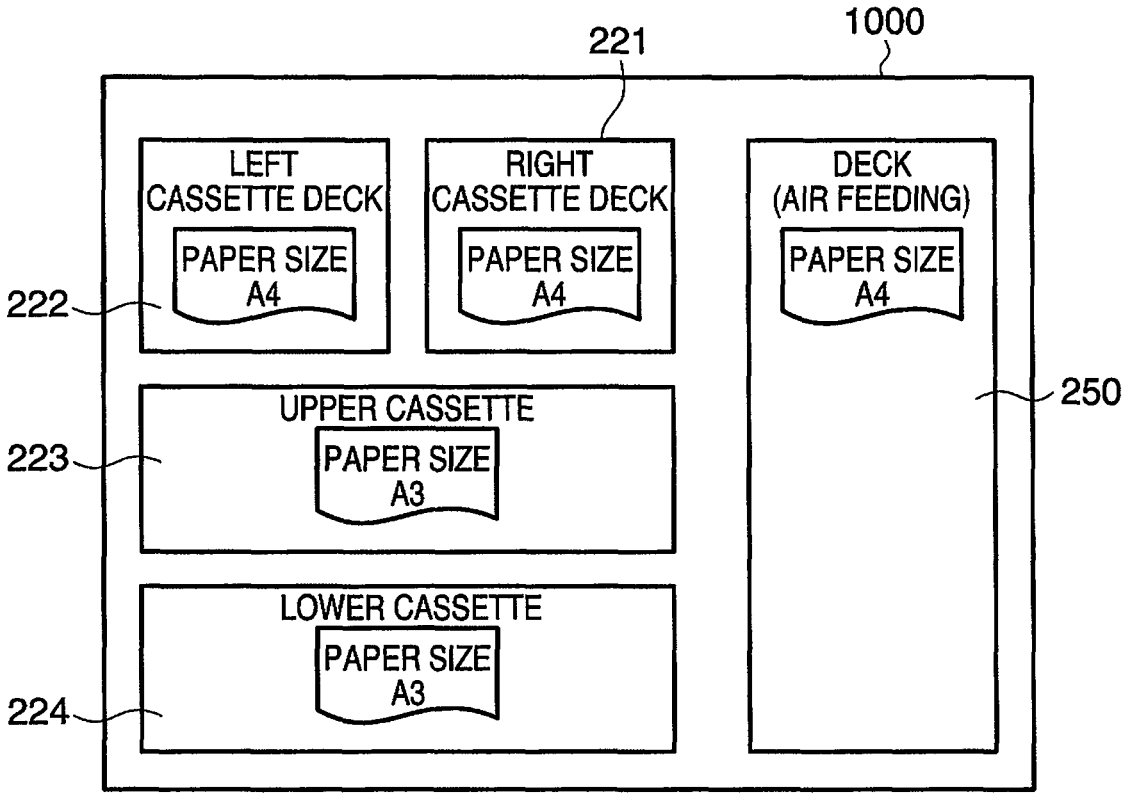
FIGS. 9A to 9C depict views showing a storage example of sheets and an example of print jobs in the digital MFP according to the third embodiment.
Figures 9B, 9C:
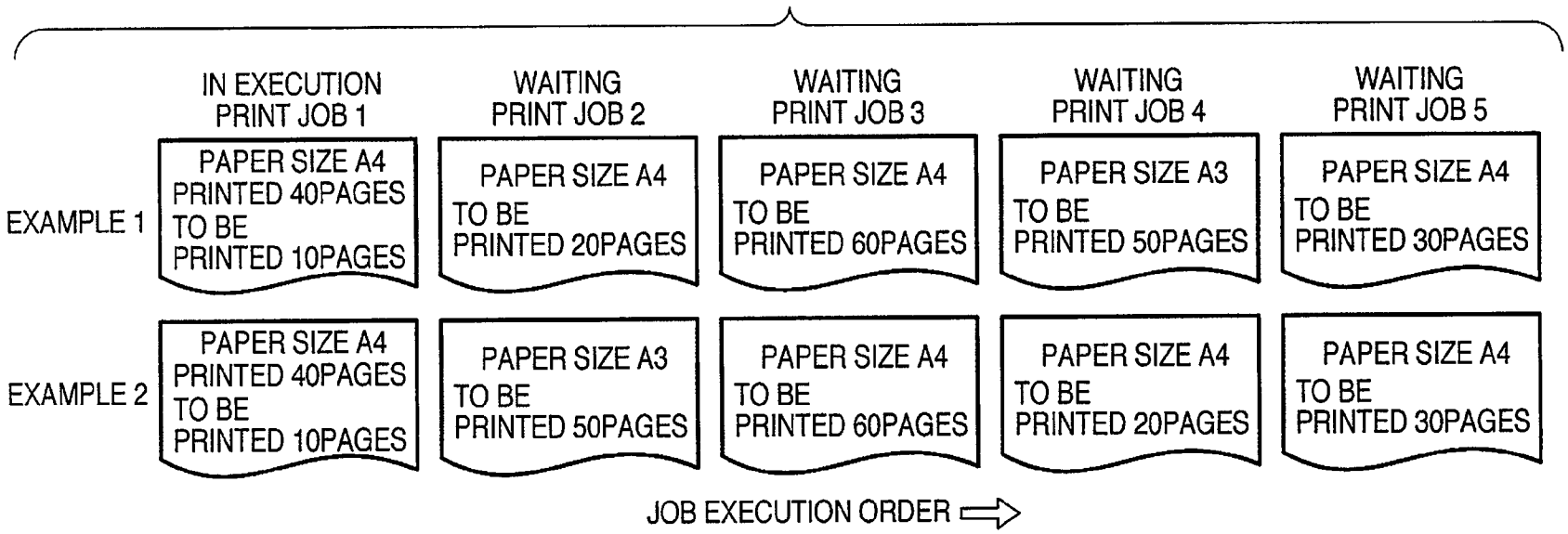

FIGS. 9A to 9C depict view showing a storage example of sheets and an example of print jobs in the digital MFP according to the third embodiment.

FIG. 9A shows the sizes of sheets which are stored in the sheet cassettes and decks of the digital MFP 1000.

Assume that the right cassette deck 221, left cassette deck 222, and deck 250 of the digital MFP 1000 respectively store A4-size sheets. Also, assume that the upper and lower cassettes 223 and 224 respectively store A3-size sheets. In FIG. 9A, the deck 250 alone allows air feeding.

FIG. 9B depicts a view explaining print jobs which are in execution and waiting.

In case of Example 1, the paper size of print jobs 1, 2, 3, and 5 is A4, and that of print job 4 is A3. At this time, if, for example, the deck 250 allows air feeding, targets for calculating the total number of pages are print jobs 1, 2, and 3 whose paper size is A4. Since the total number of pages of print job 1 which is in execution is 50, that of print job 2 which is waiting is 20, and that of print job 3 which is waiting is 60, the total number of pages of these three jobs is 130.

In case of Example 2, the paper size of print jobs 1, 3, 4, and 5 is A4, and that of print job 2 is A3. In this case, a target for calculating the total number of pages is only print job 1. Since the total number of pages of print job 1 which is in execution is 50, the total number of pages is 50.

FIG. 9C shows a view explaining the third to sixth embodiments to be described later by comparison.

In the third embodiment, the total number of pages is 130 in Example 1, and it is 50 in Example 2.

Figure 10:
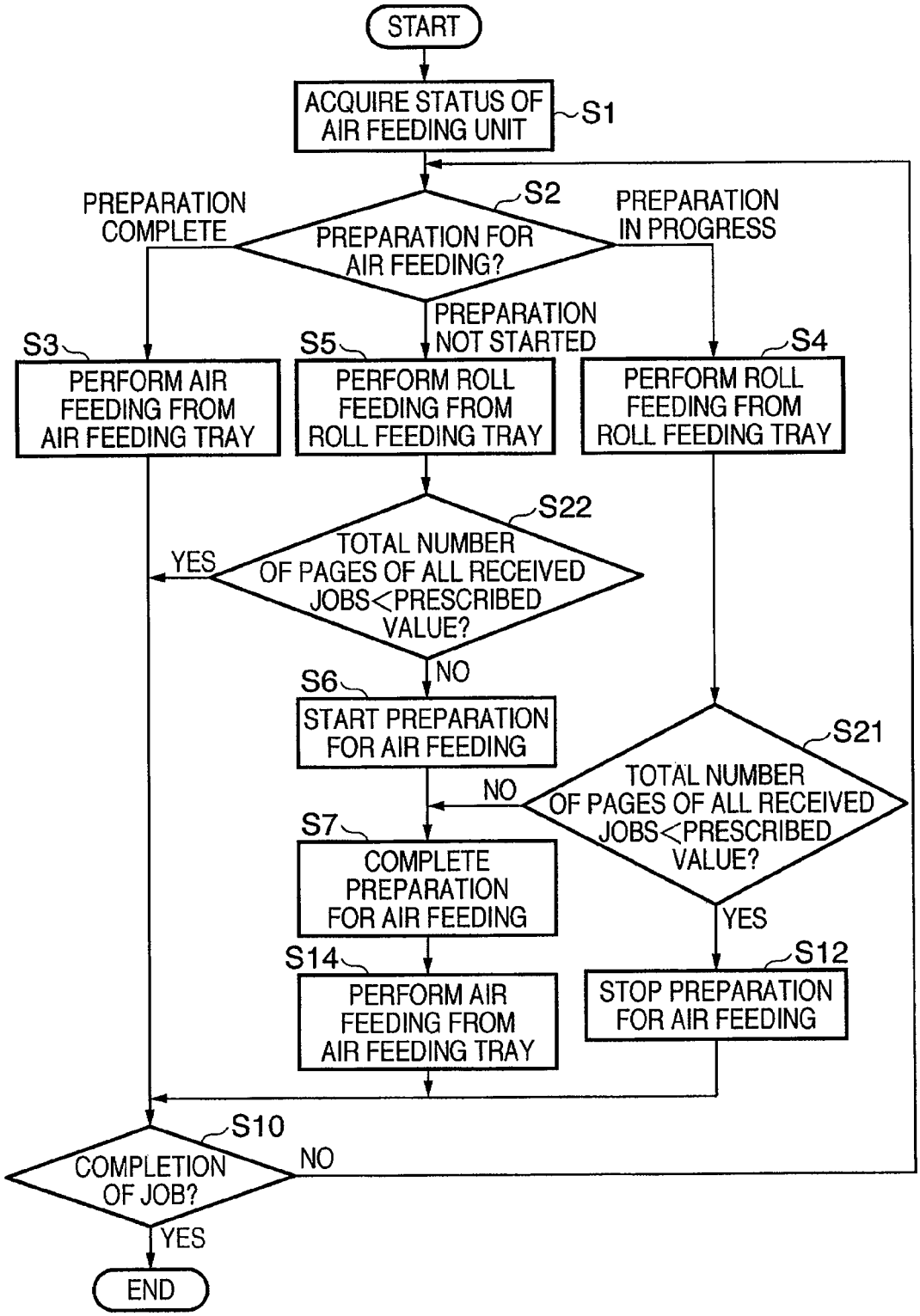
FIG. 10 is a flowchart explaining the processing for exchanging between roll feeding and air feeding of the digital MFP according to the third embodiment.

FIG. 10 is a flowchart explaining the processing for exchanging between roll feeding and air feeding in the digital MFP according to the third embodiment. Note that a program that implements this processing is stored in the ROM 115, and is executed under the control of the CPU 1113. Since the hardware arrangement of the digital MFP according to the third embodiment is the same as that in the first embodiment described above, a repetitive description thereof will be avoided. In FIG. 10, the same step numbers denote the steps (S1 to S7, S10, S12, and S14) that execute the same processes as those in FIG. 8.

This processing starts when this digital MFP 1000 receives a print job. In step S1, the CPU 1113 acquires the status of the air-feeding unit to discriminate the state of the air-feeding unit after reception of the print job. The CPU 1113 determines in step S2 whether or not a preparation to transfer sheets from the air-feeding unit is complete. If the CPU 1113 determines that a preparation to transfer sheets from the air-feeding unit is complete, the process advances to step S3 to execute the received print job by feeding sheets from the deck or cassette that stores corresponding sheets by air feeding. Then, the process advances to step S10.

On the other hand, if the preparation for air feeding (handling processing, etc.) has started but it is not complete yet in step S2 (preparation for air feeding underway), the process advances to step S4. In step S4, the CPU 1113 executes the received print job by feeding sheets from one of the cassettes that allow roll feeding (those which store A4-size sheets). The process then advances to step S21 to determine whether or not the number of pages of print jobs, which can be attained by either air feeding or roll feeding, and are scheduled to be continuously executed, is less than a prescribed value. If it is determined in step S21 that the total number of pages is less than the prescribed value, the process advances to step S12 to stop the handling processing and to end the preparation processing of air feeding. The process then advances to step S10. This is because the CPU 1113 determines that the preparation processing for air feeding is not required, since it decides that the print job by means of roll feeding is completed before air feeding is ready when the total number of pages to be printed in the print jobs is smaller than the prescribed value. If it is determined in step S21 that the total number of pages is equal to or larger than the prescribed value, the process advances to step S7.

If the preparation for air feeding (handling processing) is not started in step S2, the process advances to step S5 to execute the received print job by feeding sheets from one of the cassettes that allow roll feeding. The process advances to step S22 to determine whether or not the total number of pages of print jobs which are scheduled to be continuously executed is less than the prescribed value. If it is determined in step S22 that the total number of pages is less than the prescribed value, the process advances to step S10 without starting the preparation processing for air feeding.

On the other hand, if it is determined in step S22 that the number of pages of print jobs, which can be attained by either air feeding or roll feeding, and are scheduled to be continuously executed, is equal to or larger than the prescribed value, the process advances to step S6 to start the handling processing (to start the preparation for air feeding). If a predetermined period of time has elapsed after the beginning of the handling processing and the air feeding operation is ready in step S7, the process advances to step S14. In step S14, the CPU 1113 changes the source of the sheets from the cassette or deck that performs roll feeding to the deck 250 that allows air feeding. The process then advances to step S10. The CPU 1113 determines in step S10 whether or not the print job is complete. If the print job is complete, the processing ends; otherwise, the process returns to step S2.

Note that "the number of pages of print jobs which are scheduled to be continuously executed" may be replaced by the sum total of the numbers of pages of documents to be printed for a plurality of print jobs which are scheduled to be continuously executed by the digital MFP 1000. Alternatively, the total number of sheets to be fed for these print jobs, which is determined by the numbers of pages of documents to be printed and the print settings for respective print jobs, may be used. The print settings for each print job include the number of copies to be printed, double/single-sided settings, imposition settings (N-up or the like), and so forth.

In step S12, the preparation processing for air feeding may be continued without being stopped. However, in such case, even when the preparation processing for air feeding is complete, the print job is executed using sheets fed from the roll feeding tray without changing the source from the roll feeding tray to the air-feeding unit.

As described above, according to the third embodiment, when the total number of pages of not only a print job which is in execution but also print jobs, which can be attained by either air feeding or roll feeding and are scheduled to be continuously executed, is equal to or larger than the prescribed value, roll feeding is exchanged to air feeding.

In this way, exchange from roll feeding to air feeding can be prevented when the total number of pages of the print jobs is small (less than the prescribed value). For this reason, losses upon exchange of feeding can be minimized.

Thus, any loss time due to needless exchange of feeding can be prevented from being produced. Also, by omitting the preparation for unnecessary exchange of feeding, consumption power of the apparatus can be reduced.

Fourth Embodiment

In the first embodiment, if air feeding is ready, roll feeding is unconditionally exchanged to air feeding. By contrast, in the fourth embodiment, whether or not to exchange roll feeding to air feeding is determined based on the number of remaining pages of a print job whose printing is in progress.

Figure 11:
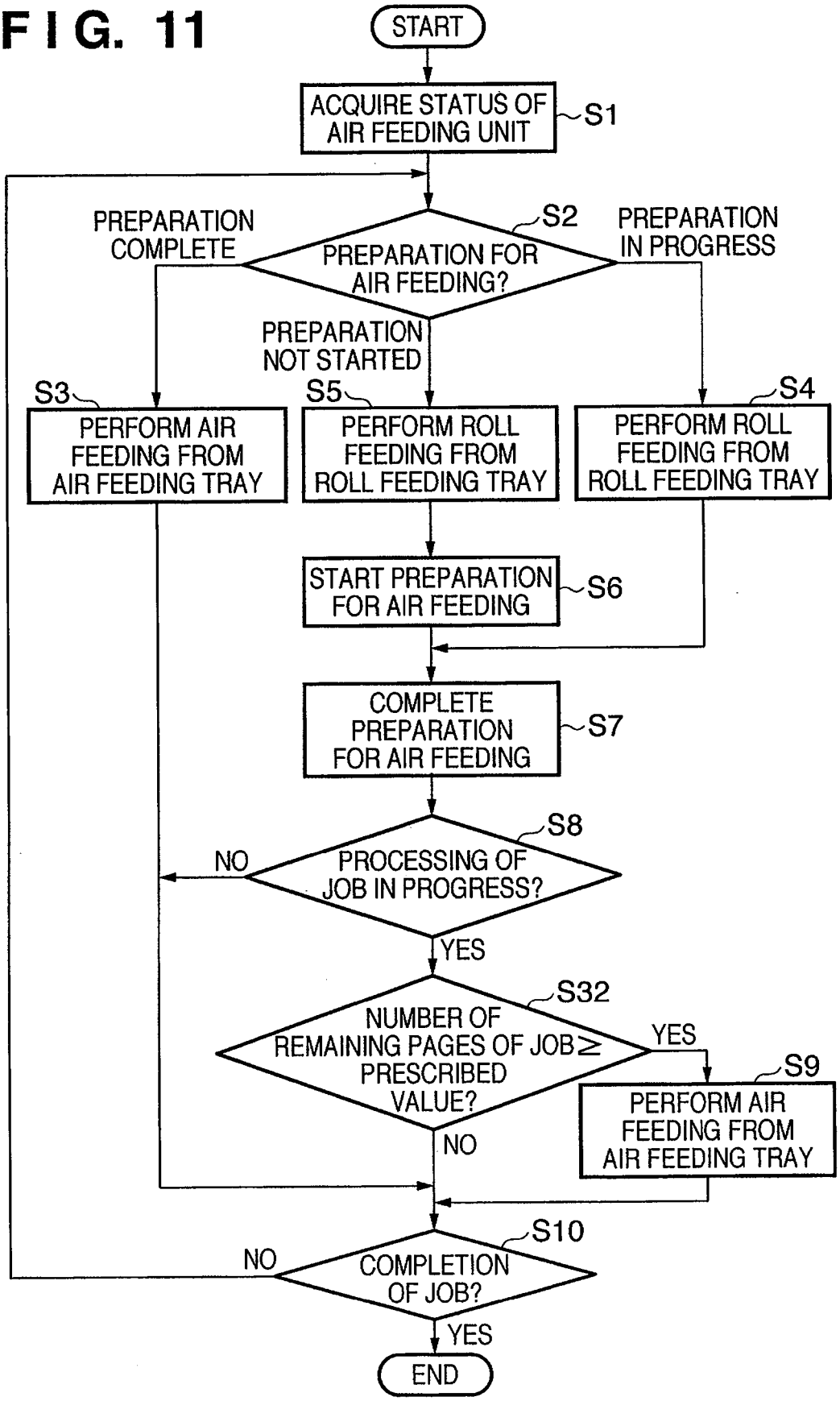
FIG. 11 is a flowchart explaining the processing for exchanging between roll feeding and air feeding of the digital MFP according to the fourth embodiment.

FIG. 11 is a flowchart explaining the processing for exchanging between roll feeding and air feeding in the digital MFP according to the fourth embodiment. Note that a program that implements this processing is stored in the ROM 115, and is executed under the control of the CPU 1113. Since the hardware arrangement of the digital MFP according to the fourth embodiment is the same as that in the first embodiment described above, a description thereof will be omitted. In FIG. 11, the same step numbers denote the steps (S1 to S10) that execute the same processes as those in FIG. 7.

This processing starts when this digital MFP 1000 receives a print job. In step S1, the CPU 1113 acquires the status of the air-feeding unit to discriminate the state of the air-feeding unit after reception of the print job. The CPU 1113 determines in step S2 whether or not a preparation to transfer sheets from the air-feeding unit is complete. If the CPU 1113 determines that a preparation to transfer sheets from the air-feeding unit is complete, the process advances to step S3 to execute the received print job by feeding sheets from the deck or cassette that stores corresponding sheets by air feeding. Then, the process advances to step S10.

On the other hand, if it is determined in step S2 that the preparation for air feeding (handling processing, etc.) has started but it is not complete yet (preparation for air feeding underway), the process advances to step S4. In step S4, the CPU 1113 executes the received print job by feeding sheets from the deck or cassette that allows roll feeding. The process then advances to step S7 to wait for completion of the preparation for air feeding.

If it is determined in step S2 that the preparation for air feeding (handling processing) is not started (preparation for air feeding is not started), the process advances to step S5 to execute the received print job by feeding sheets from the deck or cassette that allows roll feeding. Simultaneously with execution of the print job, the CPU 1113 starts the preparation for air feeding (handling processing) in step S6. After a predetermined period of time has elapsed after the beginning of the handling processing, the deck or cassette that allows air feeding is ready to start a feeding operation. The CPU 1113 determines in step S8 whether or not a print job which requires to feed sheets from the deck 250 or another cassette and to print images on the fed sheets is in execution. If it is determined in step S8 that the print job is in execution, the process advances to step S32 to determine whether or not the number of remaining pages of the print job is equal to or larger than a prescribed value. If it is determined in step S32 that the number of remaining pages is equal to or larger than the prescribed value, the process advances to step S9, and the CPU 1113 changes the source of the sheets to the deck 250 or cassette that allows air feeding to continue execution of the print job. The process then advances to step S10. The process also advances to step S10 if the processing of the print job is not in progress in step S8 or if the number of remaining pages of the print job is less than the prescribed value in step S32. In step S10, the CPU 1113 determines whether or not the print job is complete. If the print job is complete, the processing ends; otherwise, the process returns to step S2.

Note that "the number of remaining pages of the print job" may be replaced by the number of pages to be printed of a document to be printed. Alternatively, the number of remaining sheets to be printed of that to be fed by the MFP 1000 for the print job, which is determined by the number of pages of a document to be printed and the print settings for that print job, may be used. The print settings for the print job may include the number of copies to be printed, double/single-sided settings, imposition settings (N-up or the like), and so forth.

As described above, according to the fourth embodiment, whether or not to exchange roll feeding to air feeding is determined based on the number of remaining pages of the print job upon completion of the preparation for air feeding.

In this way, exchange from roll feeding to air feeding can be prevented when the total number of pages of the print jobs is small. For this reason, losses upon exchange of feeding can be minimized.

Thus, any loss time due to needless exchange of feeding can be prevented from being produced. Also, by omitting the preparation for unnecessary exchange of feeding, the consumption power of the apparatus can be reduced.

Fifth Embodiment

In the aforementioned fourth embodiment, when the number of remaining pages of the print job whose printing is in progress is equal to or larger than the prescribed value upon completion of the preparation for air feeding, roll feeding is exchanged to air feeding. By contrast, the fifth embodiment is characterized in that when the number of remaining pages of all print jobs, which can be attained by either air feeding or roll feeding and are scheduled to be continuously executed, is equal to or larger than a prescribed value upon completion of the preparation for air feeding, roll feeding is exchanged to air feeding.

A description will be given using the examples of FIG. 9B described above. In case of example 1, the paper size of print jobs 1, 2, 3, and 5 is A4, and that of print job 4 is A3. Hence, targets for calculating the number of remaining pages are print jobs 1, 2, and 3. In the example of FIG. 9B, since the number of remaining pages of print job 1 which is in execution is 10, that of print job 2 which is waiting is 20, and that of print job 3 which is waiting is 60, the total number of pages of these three jobs is 90.

In case of example 2, the paper size of print jobs 1, 3, 4, and 5 is A4, and that of print job 2 is A3. Hence, a target for calculating the number of remaining pages is only print job 1. Since the number of remaining pages of print job 1 is 10, the number of remaining pages is 10 (see FIG. 9C).

Figure 12:
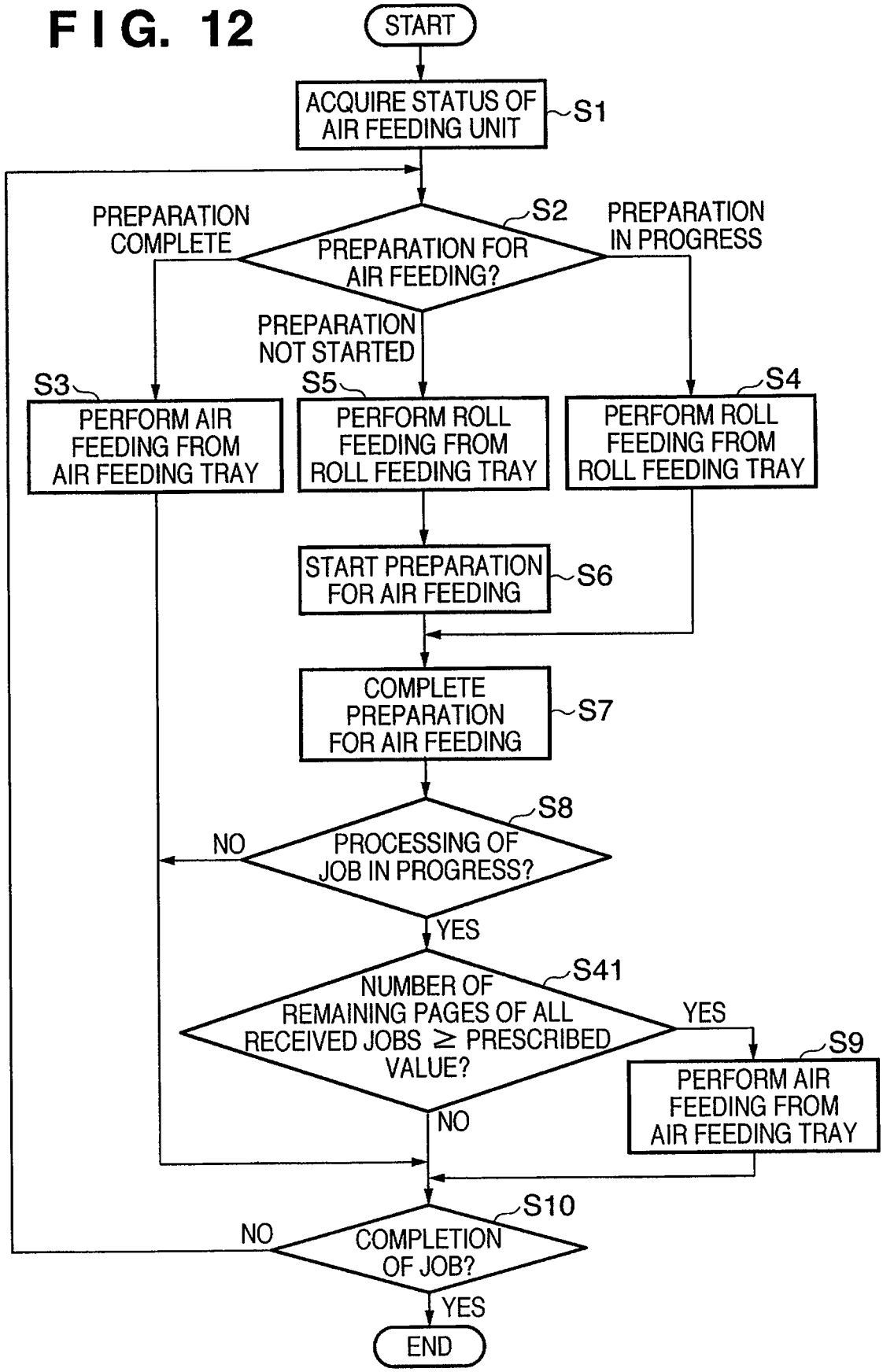
FIG. 12 is a flowchart explaining the processing for exchanging between roll feeding and air feeding of the digital MFP according to the fifth embodiment.

FIG. 12 is a flowchart for explaining the processing for exchanging between roll feeding and air feeding in the digital MFP according to the fifth embodiment. Note that a program that implements this processing is stored in the ROM 115, and is executed under the control of the CPU 1113. Since the hardware arrangement of the digital MFP according to the fifth embodiment is the same as that in the first embodiment described above, a repetitive description thereof will be avoided. In FIG. 12, the same step numbers denote the steps (S1 to S10) that execute the same processes as those in FIG. 7.

In FIG. 12, the processes in steps S1 to S10 are has described above with reference to FIG. 7. The CPU 1113 checks in step S8 if the print job which requires to feed sheets from the deck 250 and any of cassettes other than the deck 250 is in execution. If the print job is in execution, the process advances to step S41 to determine if the number of remaining pages of all print jobs, which require to feed sheets from the deck 250 and any of cassettes other than the deck 250 and are scheduled to be continuously executed, is equal to or larger than a prescribed value. If it is determined in step S41 that the number of remaining pages is less than the prescribed value, the process advances to step S10; otherwise, the process advances to step S9. In step S9, the CPU 1113 changes the source to the deck 250 or cassette that allows air feeding to continue execution of the print job.

For example, assume that the prescribed value is 60. In case of example 1 in FIG. 9B, as a result of checking in step S41, the source is changed to the deck 250 or cassette that allows air feeding. On the other hand, in case of example 2, as a result of checking in step S41, the print job is executed by roll feeding intact without changing the cassette.

As described above, according to the fifth embodiment, when the number of remaining pages of all print jobs, which can be attained by either air feeding or roll feeding and are scheduled to be continuously executed, is equal to or larger than a prescribed value upon completion of the preparation for air feeding, roll feeding is exchanged to air feeding.

In this way, exchange from roll feeding to air feeding can be prevented when the total number of pages of the print jobs is small. For this reason, losses upon exchange of feeding can be minimized.

Thus, any loss time due to needless exchange of feeding can be prevented from being produced. Also, by omitting the preparation for unnecessary exchange of feeding, the consumption power of the apparatus can be reduced.

Sixth Embodiment

In the first embodiment, if air feeding is ready, roll feeding is unconditionally exchanged to air feeding. By contrast, in the sixth embodiment, whether or not a print job which can be executed by air feeding follows a received print job is checked. If such print job follows, roll feeding is exchanged to air feeding.

A description will be given using the examples of FIG. 9B. In case of example 1, since the paper size of print job 2 is A4, sheets can be fed from the deck 250 (which can perform air feeding) or one of cassettes (which cannot perform air feeding) other than the deck 250 that contains A4 paper. In this case, the following job is termed "present".

In case of example 2, the paper size of print job 2 is A3, and sheets can only be fed from one of cassettes (which cannot perform air feeding) other than the deck 250. In this case, it is considered that the following job is "absent".

Figure 13:
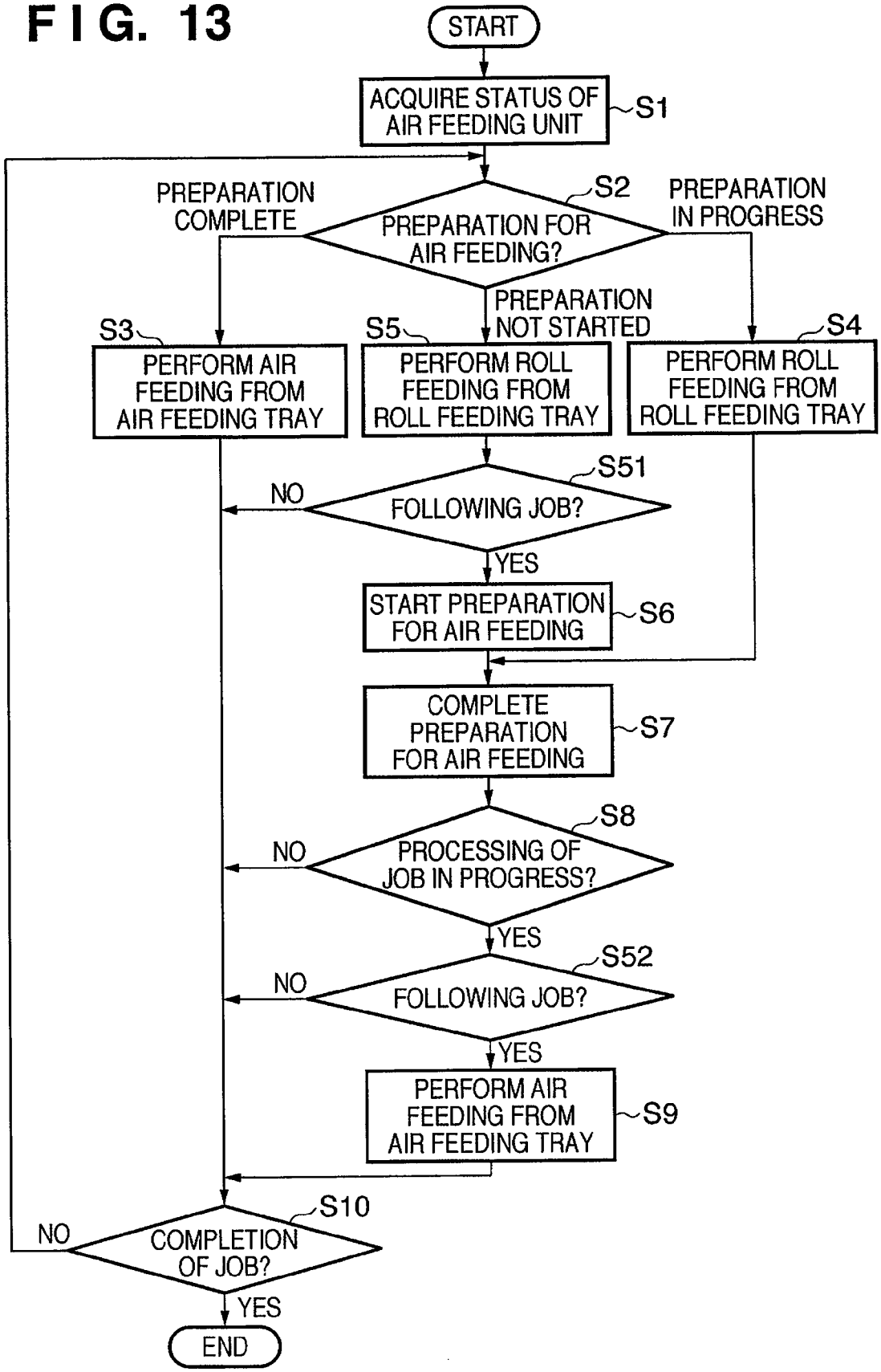
FIG. 13 is a flowchart explaining the processing for exchanging between roll feeding and air feeding of the digital MFP according to the sixth embodiment.

FIG. 13 is a flowchart for explaining the processing for exchanging between roll feeding and air feeding in the digital MFP according to the sixth embodiment. Note that a program that implements this processing is stored in the ROM 115, and is executed under the control of the CPU 1113. Since the hardware arrangement of the digital MFP according to the sixth embodiment is the same as that in the first embodiment described above, a repetitive description thereof will be avoided. In FIG. 13, the same step numbers denote the steps (S1 to S10) that execute the same processes as those in FIG. 7.

In FIG. 13, the processes in steps S1 to S10 are as has been described above with reference to FIG. 7. In step S5, the CPU 1113 executes the received print job by feeding sheets from the deck or cassette that allows roll feeding. The CPU 1113 checks in step S51 simultaneously with execution of the print job if there is a print job which follows the print job whose printing is in progress, and which print job allows feeding from the deck 250 or one of cassettes other than the deck 250 that contains A4 paper. If such following print job is found, the process advances to step S6 to start preparation processing for the air-feeding unit (handling processing). If a predetermined period of time has elapsed after the beginning of the preparation processing of the air-feeding unit, since the deck 250 is ready to feed sheets, the process then advances to step S8 to check if a print job which requires to feed sheets from the deck 250 or one of cassettes other than the deck 250 that contains A4 paper is in execution. If such a print job is in execution, the process advances to step S52 to check if a print job which allows feeding from the deck 250 or one of cassettes other than the deck 250 that contains A4 paper is scheduled to be executed immediately after that job. If such job is scheduled, the process advances to step S9, and the CPU 1113 changes the source of the sheets to the deck 250 that allows air feeding to continue printing of the print job and following print job considered above.

As described above, according to the sixth embodiment, when a print job which can be printed by either air feeding or roll feeding follows, it is determined that the following job is present (see FIG. 9C), and roll feeding is exchanged to air feeding.

In this manner, exchange from roll feeding to air feeding can be prevented when there is no following print job that uses air feeding. For this reason, losses upon exchange of feeding can be minimized.

Thus, any loss time due to needless exchange of feeding can be prevented from being produced. Also, by omitting the preparation for unnecessary exchange of feeding, consumption power of the apparatus can be reduced.

Other Embodiments

The embodiments of the present invention have been described in detail. The present invention can be applied to either a system constituted by a plurality of devices, or an apparatus consisting of a single device.

Also, each of the above embodiments may be applied to a copy job or a print job received by the facsimile unit in addition to the print job. In this case, the number of pages of a job may be calculated based on the number of documents to be copied, the number of pages of received facsimile image data, or the like.

Note that the present invention can also be achieved by directly or remotely supplying a program of software that implements the functions of the aforementioned embodiments to a system or apparatus, and reading out and executing the supplied program code by a computer of that system or apparatus. In this case, the form of program is not particularly limited as long as it has the program function.

Therefore, the program code itself installed in a computer to implement the functional processing of the present invention using the computer implements the present invention. That is, the claims of the present invention include the computer program itself for implementing the functional processing of the present invention. In this case, the form of program is not particularly limited, and an object code, a program to be executed by an interpreter, script data to be supplied to an OS, and the like may be used as long as they have the program function.

As a recording medium for supplying the program, various media can be used: for example, a Floppy® disk, hard disk, optical disk, magneto-optical disk, MO, CD-ROM, CD-R, CD-RW, magnetic tape, nonvolatile memory card, ROM, DVD (DVD-ROM, DVD-R), and the like.

As another program supply method, a program can be supplied by establishing a connection to a home page on the Internet using a browser on a client computer, and downloading the program from the home page to a recording medium such as a hard disk or the like. In this case, the program to be downloaded may be either the computer program itself of the present invention or a compressed file including an automatic installation function. Furthermore, the program code that configures the program of the present invention may be segmented into a plurality of files, which may be downloaded from different home pages. That is, the claims of the present invention include a WWW server which makes a plurality of users download a program file required to implement the functional processing of the present invention by a computer.

Also, a storage medium such as a CD-ROM or the like, which stores the encrypted program of the present invention, may be delivered to the user. In this case, the user who has cleared a predetermined condition may be allowed to download key information that decrypts the encrypted program from a home page via the Internet, so as to install the encrypted program in a computer in an executable form using that key information.

The functions of the aforementioned embodiments may be implemented by a mode other than that by executing the readout program code by the computer. For example, an OS or the like running on the computer may execute some or all of actual processes on the basis of an instruction of that program, thereby implementing the functions of the aforementioned embodiments.

Furthermore, the program read out from the recording medium may be written in a memory equipped on a function expansion board or a function expansion unit, which is inserted in or connected to the computer. In this case, after the program is written in the memory, a CPU or the like equipped on the function expansion board or unit executes some or all of actual processes based on the instruction of that program, thereby implementing the functions of the aforementioned embodiments.

As described above, the first embodiment can meet high-speed image formation by printing while exchanging between air feeding and roll feeding. Also, the first embodiment can combat the shortcomings of air feeding, i.e., a long time required until the air-feeding unit is ready to operate, and can shorten a time until the first printing.

According to the second embodiment, when the number of pages of a print job is equal to or larger than a predetermined value upon completion of the preparation for air feeding, roll feeding is exchanged to air feeding. Hence, exchange to air feeding can be prevented when the number of remaining pages of the print job is small, thus eliminating occurrence of losses upon exchange of feeding.

According to the third embodiment, when the total number of pages of not only a print job in execution but also print jobs, which can be attained by either air feeding or roll feeding and are scheduled to be continuously executed, is equal to or larger than a predetermined value upon completion of the preparation for air feeding, roll feeding is exchanged to air feeding.

In this way, exchange from roll feeding to air feeding can be prevented when the total number of pages of the print jobs is small, and losses upon exchange of feeding can be minimized.

According to the fourth embodiment, when the number of remaining pages of a print job whose printing is in progress is equal to or larger than a predetermined value upon completion of the preparation for air feeding, roll feeding is exchanged to air feeding.

As a result, exchange from roll feeding to air feeding can be prevented when the total number of pages of the print jobs is small. For this reason, losses upon exchange of feeding can be minimized.

According to the fifth embodiment, when the number of remaining pages of all print jobs, which can be attained by either air feeding or roll feeding and are scheduled to be continuously executed, is equal to or larger than a predetermined value upon completion of the preparation for air feeding, roll feeding is exchanged to air feeding.

Hence, exchange from roll feeding to air feeding can be prevented when the total number of pages of the print jobs is small. For this reason, losses upon exchange of feeding can be minimized.

As described above, according to the sixth embodiment, whether or not a print job which allows either air feeding or roll feeding follows the received print job is used as an exchange condition from roll feeding to air feeding. Hence, exchange from roll feeding to air feeding can be prevented when the total number of pages of the print jobs is small, and losses upon exchange of feeding can be minimized.

According to an embodiment of the present invention there is provided an image forming apparatus which comprises a first feeding unit that performs sheet feeding from a source of sheets using air, and a second feeding unit that performs sheet feeding from a source of sheets using a roller, comprising:

determination means for determining a state of the first feeding unit; first control means for, in a case that said determination means determines that the first feeding unit is not ready to feed upon execution of a print job that allows feeding from one of the first feeding unit and the second feeding unit, performing feeding using the second feeding unit; and second control means for, in a case that said determination means determines that the first feeding unit is ready to feed upon execution of a print job that allows feeding from one of the first feeding unit and the second feeding unit, performing feeding using the first feeding unit.

According to a further embodiment of the present invention there is provided a method of controlling an image forming apparatus which comprises a first feeding unit that performs sheet feeding from a source of sheets using air, and a second feeding unit that performs sheet feeding from a source of sheets using a roller, comprising: a determination step of determining a state of air feeding in the first feeding unit; a roll feed step of performing, in a case that it is determined in said determination step that the first feeding unit is not ready to feed upon execution of a print job that allows feeding from one of the first feeding unit and the second feeding unit, feeding using the second feeding unit; and an air feed step of performing, in a case that it is determined in said determination step that the first feeding unit is ready to feed upon execution of a print job that allows feeding from one of the first feeding unit and the second feeding unit, feeding using the first feeding unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-65778, filed Mar. 14, 2007, which is hereby incorporated by reference herein its entirety.

What is claimed is:

1. An image-forming apparatus comprising:

a first feeding unit configured to separate a sheet from other sheets using air, and feed the sheet;

a second feeding unit configured to feed a sheet using a roller;

a determination unit configured to determine whether the first feeding unit can feed the sheet existing in the first feeding unit or the first feeding unit cannot feed the sheet existing in the first feeding unit; and a control unit configured to control, in a case that the determination unit determines that the first feeding unit cannot feed the sheet for a print job for printing an image on the sheet fed from one of the first feeding unit and the second feeding unit, the second feeding unit to feed the sheet, and to control to, in a case that the determination unit determines that the first feeding unit can feed the sheet for the print job, cause the first feeding unit to feed the sheet.

2. The apparatus according to claim 1, further comprising a changing unit configured to, if the first feeding unit becomes ready to feed the sheet for the print job, change sheet feeding for the print job from the second feeding unit to the first feeding unit.

3. The apparatus according to claim 1, wherein the control unit controls the first feeding unit to separate the sheet for feeding the sheet if the determination unit determines that the first feeding unit cannot feed the sheet separated using air and the number of pages to be printed by an execution of the print job is not less than a prescribed value.

4. The apparatus according to claim 1, wherein the control unit controls the first feeding unit to separate the sheet for feeding the sheet if the determination unit determines that the first feeding unit cannot feed the sheet separated using air and the total number of sheets which are to be fed from the first feeding unit and/or the second feeding unit and which are to be printed by the image-forming apparatus is not less than a prescribed value.

5. The apparatus according to claim 1, wherein the control unit controls the first feeding unit to separate the sheet for feeding the sheet if the first feeding unit does not start to separate the sheet, and the image-forming apparatus further comprises a changing unit configured to change sheet feeding for the print job to the first feeding unit, if the number of remaining pages to be printed by an execution of the print job is not less than a prescribed value after the first feeding unit becomes to be able to feed the sheet separated using air.

6. The apparatus according to claim 1, wherein the control unit controls the first feeding unit to separate the sheet for feeding the sheet if the first feeding unit does not start to separate the sheet, and the image-forming apparatus further comprises a changing unit configured to change sheet feeding for the print job to the first feeding unit if the number of remaining sheets which are to be fed from the first feeding unit and/or the second feeding unit and which are to be printed by the image forming apparatus is not less than a prescribed value after the first feeding unit becomes to be able to feed the sheet separated using air.

7. The apparatus according to claim 1, wherein the control unit controls the first feeding unit to separate the sheet for feeding the sheet if the first feeding unit does not start to separate the sheet, and the image-forming apparatus further comprises a changing unit configured to change sheet feeding for the print job to the first feeding unit in a case that the number of sheets to be fed by an execution of the print job is not less than a prescribed value after the first feeding unit becomes to be able to feed the sheet separated using air.

8. The apparatus according to claim 1, wherein the control unit controls the first feeding unit to separate the sheet for feeding the sheet in a case that the determination unit determines that the first feeding unit cannot feed the sheet separated using air and there is a print job which follows the print job.

9. The apparatus according to claim 1, wherein the determination unit determines whether the first feeding unit can feed the sheet separated using air after a predetermined period of time.

10. The apparatus according to claim 1, wherein the first feeding unit separates the sheet by blowing out air to the other sheets loaded in the first feeding unit.

11. A control method of controlling an image-forming apparatus which comprises a first feeding unit for separating a sheet from other sheets using air and feed the sheet, and a second feeding unit for feeding a sheet using a roller, comprising the steps of:

determining whether the first feeding unit can feed the sheet existing in the first feeding unit or the first feeding unit cannot feed the sheet existing in the first feeding unit; and if it is determined that the first feeding unit cannot feed the sheet for a print job for printing an image on the sheet fed from one of the first feeding unit and the second feeding unit, controlling the second feeding unit to feed the sheet; and if it is determined that the first feeding unit can feed the sheet for the print job, controlling the first feeding unit to feed the sheet.

12. A method according to claim 11, further comprising a step of changing feeding of sheets from the second feeding unit to the first feeding unit, if the first feeding unit becomes ready to feed the sheet for the print job.

13. A method according to claim 11, further comprising a step of controlling the first feeding unit to separate the sheet for feeding the sheet if it is determined in the determination step that the first feeding unit cannot feed the sheet separated using air and the number of pages to be printed by an execution of the print job is not less than a prescribed value.

14. A method according to claim 13, wherein said causing step of controlling the first feeding unit to separate the sheet by blowing out air to the other sheets loaded in the first feeding unit.

15. A method according to claim 11, further comprising a step of controlling the first feeding unit to separate the sheet for feeding the sheet if it is determined in the determination step that the first feeding unit cannot feed the sheet separated using air and the total number of sheets which are to be fed from the first feeding unit and/or the second feeding unit and which are to be printed by the image-forming apparatus is not less than a prescribed value.

16. A method according to claim 11, further comprising a step of controlling the first feeding unit to separate the sheet for feeding the sheet if the first feeding unit does not start to separate the sheet, and the image-forming apparatus further comprises a changing step of changing sheet feeding for the print job to the first feeding sheet if the number of remaining pages to be printed by an execution of the print job is not less than a prescribed value after the first feeding unit becomes to be able to feed the sheet separated using air.

17. A method according to claim 11, further comprising a step of controlling the first feeding unit to separate the sheet for feeding the sheet if the first feeding unit does not start to separate the sheet, and the image-forming apparatus further comprises a changing step of changing sheet feeding for the print job to the first feeding unit, if the number of remaining sheets which are to be fed from the first feeding unit and/or the second feeding unit and which to be printed by the image-forming apparatus is not less than a prescribed value after the first feeding unit becomes to be able to feed the sheet separated using air.

18. A method according to claim 11, further comprising a step of controlling the first feeding unit to separate the sheet for feeding the sheet if the first feeding unit does not start to separate the sheet, and the image-forming apparatus further comprises a changing step of changing sheet feeding for the print job to the first feeding unit, if the number of sheets to be fed by an execution of the print job is not less than a prescribed value after the first feeding unit becomes to be able to feed the sheet separated using air.

19. A method according to claim 11, further comprising a step of controlling the first feeding unit to separate the sheet for feeding the sheet if it is determined in the determination step that the first feeding unit cannot feed the sheet separated using air and there is a print job which follows the print job.

20. A method according to claim 11, wherein it is determined in the determining step whether the first feeding unit can feed the sheet separated using air after a predetermined period of time.

21. A non-transitory computer-readable medium storing a program adapted to be executed by a computer or processor in an image-forming apparatus that has a first feeding unit for separating a sheet from other sheets using air, and feed the sheet, and a second feeding unit for feeding a sheet using a roller, the program when executed causing the image forming apparatus to:

determine whether the first feeding unit can feed the sheet existing in the first feeding unit or the first feeding unit cannot feed the sheet existing in the first feeding unit; and if it is determined that the first feeding unit cannot feed the sheet for a print job for printing the sheet fed from one of the first feeding unit and the second feeding unit, controlling the second feeding unit to feed the sheet; and if it is determined that the first feeding unit can feed the sheet for a print job for printing the sheet fed from one of the first feeding unit and the second feeding unit, controlling the first feeding unit to feed the sheet.

* * * * *